US007642032B2

(12) United States Patent
Sugiura et al.

(10) Patent No.: US 7,642,032 B2
(45) Date of Patent: Jan. 5, 2010

(54) TONER, DEVELOPER, IMAGE FORMING APPARATUS AND IMAGE FORMING METHOD

(75) Inventors: Hideki Sugiura, Fuji (JP); Satoshi Mochizuki, Numazu (JP); Akihiro Kotsugai, Numazu (JP); Yasuo Asahina, Numazu (JP); Osamu Uchinokura, Numazu (JP); Hisashi Nakajima, Numazu (JP); Tomoyuki Ichikawa, Numazu (JP); Shinya Nakayama, Numazu (JP); Kohichi Sakata, Numazu (JP); Tomoko Utsumi, Numazu (JP); Hitoshi Iwatsuki, Yokohama (JP); Yasuaki Iwamoto, Numazu (JP)

(73) Assignee: Ricoh Company, Limited, Tokyo (JP)

( * ) Notice: Subject to any disclaimer, the term of this patent is extended or adjusted under 35 U.S.C. 154(b) by 218 days.

(21) Appl. No.: 10/959,663

(22) Filed: Oct. 7, 2004

(65) Prior Publication Data

US 2005/0089786 A1 Apr. 28, 2005

(30) Foreign Application Priority Data

Oct. 22, 2003 (JP) ..... 2003-361586

(51) Int. Cl.
*G03G 9/08* (2006.01)

(52) U.S. Cl. ..... 430/109.4; 430/105; 430/110.3

(58) Field of Classification Search ..... 430/109.1, 430/109.3, 109.4, 110.3
See application file for complete search history.

(56) References Cited

U.S. PATENT DOCUMENTS 4,074,001 A 2/1978 Imai et al.
4,172,976 A 10/1979 Namiki et al.
4,284,875 A 8/1981 Namiki et al.
4,762,763 A 8/1988 Nomura et al.
4,841,331 A 6/1989 Nakayama et al.
4,933,250 A 6/1990 Nakayama et al.
4,945,022 A 7/1990 Nakayama et al.
4,980,258 A 12/1990 Aoki et al.
5,061,588 A 10/1991 Fushimi et al.
5,225,303 A 7/1993 Tomita et al.
5,314,777 A 5/1994 Watanabe et al.
5,344,732 A 9/1994 Chiba et al.
5,368,972 A 11/1994 Yamashita et al.

(Continued)

FOREIGN PATENT DOCUMENTS

JP 63-186253 8/1988

(Continued)

OTHER PUBLICATIONS

Principles of Polymerization, 3rd Ed. George Odian, John Wiley and Sons, Inc. NY, 1991.*

(Continued)

*Primary Examiner*—Mark F Huff
*Assistant Examiner*—Peter L Vajda
(74) *Attorney, Agent, or Firm*—Oblon, Spivak, McClelland, Maier & Neustadt, L.L.P.

(57) ABSTRACT

A toner including a binder resin; and a colorant, wherein a hexafluoroisopropanol (HFIP)-soluble component satisfies the following relationship:

$$2{,}000 \leqq Mn \leqq 7{,}000 \text{ and } 1.5 \leqq Mn/Mw \leqq 10$$

wherein Mn represents a number-average molecular weight and Mw represents a weight-average molecular weight.

10 Claims, 7 Drawing Sheets

U.S. PATENT DOCUMENTS 5,403,690 A 4/1995 Kuramoto et al.
5,418,103 A 5/1995 Muto et al.
5,429,901 A 7/1995 Muto et al.
5,514,511 A 5/1996 Iwamoto et al.
5,545,381 A 8/1996 Iida et al.
5,554,478 A 9/1996 Kuramoto et al.
5,612,766 A 3/1997 Iida et al.
5,652,079 A 7/1997 Mochizuki et al.
5,659,860 A 8/1997 Sasaki et al.
5,712,072 A * 1/1998 Inaba et al. ..... 430/108.4
5,771,426 A 6/1998 Oka et al.
5,840,456 A 11/1998 Tomita et al.
5,912,100 A 6/1999 Aoki et al.
5,975,446 A 11/1999 Yaguchi et al.
6,004,715 A 12/1999 Suzuki et al.
6,010,814 A 1/2000 Kotsugai et al.
6,074,794 A 6/2000 Fushimi et al.
6,168,894 B1 1/2001 Aoki et al.
6,183,926 B1 2/2001 Kuroda et al.
RE37,197 E 5/2001 Iida et al.
6,258,502 B1 7/2001 Nakamura et al.
6,303,257 B1 10/2001 Hasegawa et al.
6,303,258 B1 10/2001 Katoh et al.
6,356,729 B1 3/2002 Sasaki et al.
6,360,068 B1 3/2002 Kinoshita et al.
6,363,229 B1 3/2002 Shiraishi et al.
6,368,765 B2 4/2002 Izu et al.
6,406,826 B1 6/2002 Suzuki et al.
6,416,914 B1 7/2002 Nakamura et al.
6,432,589 B1 8/2002 Uchinokura et al.
6,432,590 B1 8/2002 Ueda et al.
6,468,706 B2 10/2002 Matsuda et al.
6,472,118 B1 10/2002 Yamaguchi et al.
6,489,073 B2 10/2002 Kotsugai et al.
6,479,204 B1 11/2002 Uchinokura et al.
6,500,595 B1 12/2002 Mochizuki et al.
6,503,676 B2 1/2003 Yamashita et al.
6,503,681 B2 1/2003 Makino et al.
6,526,246 B2 2/2003 Iwata et al.
6,542,707 B2 4/2003 Muramatsu et al.
6,544,704 B1 4/2003 Matsuda et al.
6,566,026 B2 5/2003 Watanabe et al.
6,593,048 B2 7/2003 Sasaki et al.
6,597,883 B2 7/2003 Muramatsu et al.
6,599,672 B2 7/2003 Yamaguchi et al.
6,628,908 B2 9/2003 Matsumoto et al.
6,628,913 B2 9/2003 Matsumoto et al.
6,630,276 B2 10/2003 Sugiura et al.
6,641,969 B2 11/2003 Uchinokura et al.
6,653,037 B2 11/2003 Sawada et al.
6,660,443 B2 12/2003 Sugiyama et al.
6,667,141 B2 12/2003 Iwamoto et al.
6,696,213 B2 2/2004 Yamaguchi et al.
6,699,632 B2 3/2004 Higuchi et al.
6,716,561 B2 4/2004 Shiraishi et al.
6,733,939 B2 5/2004 Nanya et al.
6,735,409 B2 5/2004 Takahashi et al.
6,737,210 B2 5/2004 Uchinokura et al.
6,739,534 B2 5/2004 Yamaguchi et al.
6,743,558 B2 6/2004 Yamaguchi et al.
6,757,507 B2 6/2004 Mochizuki et al.
6,770,411 B2 8/2004 Masuda et al.
6,780,556 B2 8/2004 Sugiura et al.
6,790,575 B2 9/2004 Sasaki et al.
2002/0006564 A1 1/2002 Kondou et al.
2002/0025184 A1* 2/2002 Ishikawa et al. ..... 399/111
2002/0039698 A1 4/2002 Sasaki et al.
2002/0081513 A1 6/2002 Higuchi et al.
2002/0155366 A1 10/2002 Mochizuki et al.
2002/0159797 A1 10/2002 Matsuda et al.
2002/0160290 A1 10/2002 Sugiura et al.
2002/0177060 A1 11/2002 Matsuda et al.
2003/0022080 A1 1/2003 Fushimi et al.
2003/0082472 A1 5/2003 Kondo et al.
2003/0096183 A1 5/2003 Katoh et al.
2003/0104297 A1 6/2003 Matsuda et al.
2003/0129518 A1 7/2003 Sawada et al.
2003/0138717 A1 7/2003 Yagi et al.
2003/0138718 A1 7/2003 Yagi et al.
2003/0152857 A1 8/2003 Sugiura et al.
2003/0162115 A1 8/2003 Uchinokura et al.
2003/0165760 A1 9/2003 Higuchi et al.
2003/0180643 A1 9/2003 Suzuki et al.
2003/0180644 A1 9/2003 Nanya et al.
2003/0186154 A1 10/2003 Suzuki et al.
2003/0186155 A1 10/2003 Aoki et al.
2003/0190543 A1 10/2003 Sugiura et al.
2003/0210930 A1 11/2003 Nakai et al.
2003/0219669 A1 11/2003 Yamashita et al.
2003/0219670 A1 11/2003 Sawada et al.
2003/0224279 A1 12/2003 Kotsugai et al.
2003/0232266 A1 12/2003 Sugiura et al.
2003/0232959 A1* 12/2003 Adelman et al. ..... 528/272
2004/0005290 A1* 1/2004 Fukui et al. ..... 424/78.37
2004/0053154 A1 3/2004 Tomita et al.
2004/0058260 A1 3/2004 Katoh et al.
2004/0067189 A1 4/2004 Sugiura et al.
2004/0072091 A1 4/2004 Mochizuki et al.
2004/0076443 A1 4/2004 Suzuki et al.
2004/0076900 A1 4/2004 Sugiyama et al.
2004/0081906 A1* 4/2004 Kenmoku et al. ..... 430/108.4
2004/0091287 A1 5/2004 Matsumoto et al.
2004/0115550 A1 6/2004 Sugiura et al.
2004/0115551 A1 6/2004 Sugiyama et al.
2004/0121256 A1 6/2004 Suzuki et al.
2004/0126147 A1 7/2004 Kondo et al.
2004/0131961 A1 7/2004 Watanabe et al.
2004/0137356 A1 7/2004 Tomita et al.
2004/0142264 A1 7/2004 Tanaka et al.
2004/0142265 A1 7/2004 Tomita et al.
2004/0142269 A1 7/2004 Kotsugai et al.
2004/0146795 A1 7/2004 Emoto et al.
2004/0157146 A1 8/2004 Tomita et al.
2004/0157147 A1 8/2004 Shiraishi et al.
2004/0191660 A1* 9/2004 Otsuka et al. ..... 430/108.23
2004/0229147 A1* 11/2004 Higuchi et al. ..... 430/110.3

FOREIGN PATENT DOCUMENTS

JP 05-341617 12/1993
JP 09-015903 1/1997
JP 09-043909 2/1997
JP 09-258474 10/1997
JP 10-073956 3/1998
JP 11-133667 5/1999
JP 11-149176 6/1999
JP 2000-292973 10/2000
JP 2000-292978 10/2000
JP 2002-351143 12/2002

OTHER PUBLICATIONS

U.S. Appl. No. 10/752,589, filed Jan. 8, 2004, Masuda, et al.
U.S. Appl. No. 10/724,260, filed Dec. 1, 2003, Yagi, et al.
U.S. Appl. No. 09/712,927, filed Nov. 16, 2000.
U.S. Appl. No. 09/384,797, filed Aug. 27, 1999, Miyamoto, et al.
U.S. Appl. No. 09/010,583, filed Jan. 22, 1998, Aoki, et al.
U.S. Appl. No. 07/190,068, filed May 4, 1988, Asahina, et al.
U.S. Appl. No. 06/928,605, filed Nov. 3, 1986, Inoue.
U.S. Appl. No. 06/741,360, filed Jun. 5, 1985, Inoue.
U.S. Appl. No. 11/519,057, filed Sep. 12, 2006, Nakayama et al.
U.S. Appl. No. 11/338,700, filed Jan. 25, 2006, Kotsugai, et al.
U.S. Appl. No. 11/234,415, filed Sep. 26, 2005, Nakayama, et al.
U.S. Appl. No. 11/227,178, filed Sep. 16, 2005, Hasegawa, et al.
U.S. Appl. No. 11/080,542, filed Mar. 16, 2005, Uchinokura, et al.

U.S. Appl. No. 11/558,736, filed Nov. 10, 2006, Uchinokura, et al.
U.S. Appl. No. 11/608,521, filed Dec. 8, 2006, Satoru, et al.
U.S. Appl. No. 11/685,872, filed Mar. 14, 2007, Uchinokura, et al.
U.S. Appl. No. 11/685,969, filed Mar. 14, 2007, Uchinokura, et al.
U.S. Appl. No. 11/868,618, filed Oct. 8, 2007, Sugiyama, et al.
U.S. Appl. No. 11/738,149, filed Apr. 20, 2007, Iwamoto, et al.
U.S. Appl. No. 11/755,484, filed May 30, 2007, Watanabe, et al.
U.S. Appl. No. 11/755,517, filed May 30, 2007, Iwamoto, et al.
U.S. Appl. No. 11/851,475, filed Sep. 7, 2007, Watanabe, et al.
U.S. Appl. No. 11/852,778, filed Sep. 10, 2007, Nagatomo, et al.
U.S. Appl. No. 11/853,490, filed Sep. 11, 2007, Miyamoto, et al.
U.S. Appl. No. 11/857,791, filed Sep. 19, 2007, Kojima, et al.
U.S. Appl. No. 12/042,041, filed Mar. 4, 2008, Yamada, et al.
U.S. Appl. No. 12/048,823, filed Mar. 14, 2008, Honda, et al.
U.S. Appl. No. 12/050,502, filed Mar. 18, 2008, Yamada, et al.
U.S. Appl. No. 12/046,011, filed Mar. 11, 2008, Nagatomo, et al.
U.S. Appl. No. 12/047,807, filed Mar. 12, 2008, Honda, et al.
U.S. Appl. No. 12/013,108, filed Jan. 11, 2008, Yagi, et al.
U.S. Appl. No. 12/040,451, filed Feb. 29, 2008, Saitoh, et al.
U.S. Appl. No. 11/956,378, filed Dec. 14, 2007, Shu, et al.
U.S. Appl. No. 11/934,929, filed Nov. 21, 2007, Nakayama, et al.
U.S. Appl. No. 11/870,613, filed Oct. 11, 2007, Iwatsuki, et al.
U.S. Appl. No. 11/950,114, filed Dec. 4, 2007, Shitara, et al.
U.S. Appl. No. 12/203,278, filed Sep. 3, 2008, Yamada, et al.
U.S. Appl. No. 12/252,693, filed Oct. 16, 2008, Sakata.

* cited by examiner

TONER, DEVELOPER, IMAGE FORMING APPARATUS AND IMAGE FORMING METHOD

BACKGROUND OF THE INVENTION

1. Field of the Invention

The present invention relates to advances in electrophotographic image formation, including a toner, a developer, an image forming apparatus and an image forming method.

2. Discussion of the Background

In an electrophotographic image forming apparatus and an electrostatic recording apparatus and the like, a toner is adhered to an electrostatic latent image formed on a photoreceptor to form a toner image thereon, the toner image is transferred onto a transfer material and is fixed thereon with a heat. A full-color image is typically reproduced with four color toners, i.e., a black toner, a yellow toner, a magenta toner and a cyan toner. Each color is developed with each of the toners, which are overlapped on one another and fixed together with heat on a transfer material to form a full-color image thereon.

However, users who are used to seeing prints are not typically satisfied with the image quality produced by a full-color copier yet, and a higher definition and resolution close to photographs and prints thereof are required. It is known that toner having a small particle diameter and a narrow distribution thereof is used to produce high-quality images in electrophotography.

Conventionally, an electrostatic or a magnetic latent image is visualized by a toner. The toner for use in developing the electrostatic latent image is a colored particle formed of a binder resin including a colorant, a charge controlling agent and other additives. The toner is mostly prepared by a pulverization method and a polymerization method.

The pulverization method includes kneading a colorant, a charge controlling agent, offset inhibitor and the like in a thermoplastic resin upon application of heat, uniformly dispersing them therein to prepare a mixed composition, and pulverizing and classifying the mixed composition to prepare a toner. The pulverization method can prepare a toner having good properties to some extent, however, materials therefor are limited. For example, the mixed composition prepared by kneading upon application of heat should be pulverized and classified by an economically usable pulverizer. Therefore, the mixed composition should be sufficiently blendable.

The pulverized toner tends to have a wide particle diameter distribution, and for example, fine particles having a diameter not greater than 5 μm and coarse particles having a diameter not less than 20 μm have to be removed to produce images having good image resolution and tone reproduction, and therefore yield decreases. In addition, it is difficult to uniformly disperse the colorant, charge controlling agent and the like in the thermoplastic resin by the pulverization method. Nonuniform dispersion thereof adversely affects fluidity, developability and durability of the resultant toner and image quality produced thereby.

Japanese Laid-Open Patent Publication No. 9-43909 discloses a suspension polymerization method of preparing a toner. However, the toner prepared thereby has a spherical shape but has poor cleanability. Since there is less residual toner after transferred when an image having a low image area is developed or transferred, the poor cleanability is not a serious problem. However, when an image having a high image area such as a photograph image is developed or transferred, untransferred toner remains on a photoreceptor as a residual toner after transferred, and which causes background fouling of images produced thereby when accumulated. In addition, the toner contaminates a charging roller charging the photoreceptor while contacting the photoreceptor and impairs the original chargeability thereof. Further, the toner does not have sufficient low-temperature fixability and much energy us consumed to fix the toner.

Japanese Patent No. 2537503 discloses a method of preparing an amorphous toner particle by assembling a particulate resin prepared by an emulsifying polymerization method. However, a large amount of a detergent remains not only on the toner particle but also therein, and impairs atmospheric charge stability and widens charge quantity distribution of the toner, resulting in background fouling of images produced thereby. In addition, the remaining detergent contaminates a photoreceptor, a charging roller and a developing roller and impairs the original chargeability thereof.

In a fixing process by contact heating using a heating member such as a heat roller, releasability of a toner particle from the heating member (hereinafter referred to as offset resistance) is required. The offset resistance can be improved by making a release agent present on the surface of the toner particle. Japanese Laid-Open Patent Publications Nos. 2000-292973 and 2000-292978 disclose a method of improving the offset resistance by not only including a particulate resin in the toner particle but also unevenly distributing the particulate resin on the surface thereof. However, a lowest fixable temperature increases and low-temperature fixability, i.e., energy saving fixability is insufficient.

Further, the method of preparing an amorphous toner particle by assembling a particulate resin prepared by an emulsifying polymerization method has the following problems. Namely, when a particulate release agent is assembled with a toner particle to improve the offset resistance thereof, the particulate release agent is taken therein, resulting in insufficient improvement of the offset resistance. Since a particulate rein, a particulate release agent and a particulate colorant are randomly fusion bonded to form a toner particle, compositions (component content ratios) and molecular weights of resins fluctuate. Therefore, surface properties of the toner particles are different from one another and images having good quality cannot be produced for long periods. Further, the particulate resin unevenly distributed on the surface of a toner impairs low-temperature fixability thereof.

A solution suspension method is known as a method of preparing a toner. The method has the advantage of being able to use a polyester resin capable of being fixed at a low temperature. However, since a polymer material is included in a process of dissolving or dispersing a low-temperature fixable resin and a colorant in a solvent in this method, the resultant liquid viscosity increases and the productivity reduces. In the solution suspension method, Japanese Laid-Open Patent Publication No. 9-15903 discloses a method of improving cleanability of a toner by making the shape of a toner spherical and having the surface thereof concave and convex. However, when a wax is included in such a toner as a release agent, the wax and a pigment are less dispersed therein than in a kneaded and pulverized toner and the wax is granulated in a solvent. Therefore, the resultant toner does not have sufficient releasability.

The suspension polymerization method, emulsifying polymerization method and solution suspension method typically use a styrene acrylic resin, and has difficulty in controlling diameter, a distribution thereof and a shape when using a polyester resin. In addition, the lowest fixable temperature has a limit.

Japanese Laid-Open Patent Publication No. 11-133667 discloses a method of using a urea-modified polyester resin for the purpose of improving thermostable preservability and low-temperature fixability. However, the resultant toner does not have sufficient atmospheric charge stability.

In the electrophotographic field, higher quality images are studied from various angles, and particularly it is recognized that the smaller diameter and conglobation of a toner are highly effective. However, the smaller the diameter of the toner, the lower the transferability and fixability thereof, resulting in production of images having poor quality. Japanese Laid-Open Patent Publication No. 9-258474 discloses a method of conglobating a toner to improve transferability thereof. In this surroundings, color copiers and color printers are required to produce images at a higher speed.

To produce images at a higher speed, a tandem method can be used as disclosed in Japanese Laid-Open Patent Publication No. 5-341617. The tandem method is a method of producing a full-color image on a transfer paper by sequentially overlying each of images produced by plural image forming units thereon. The tandem-type full-color image forming apparatus can use a variety of transfer papers and produces high-quality full-color images at a higher speed than the other types of full-color image forming apparatus. An attempt to use a spherical toner is also made. However, a higher fixability is required to produce images at a higher speed, and the spherical toner does not have good low-temperature fixability.

A toner is required not to agglutinate and have no or less deterioration of chargeability, fluidity, transferability and fixability even in an environment of high temperature and high humidity, and that of low temperature and low humidity when stored and transported. However, such a spherical toner is not available.

A heat and pressure fixing method of directly contacting a fixing member such as a fixing roller and a fixing belt to an unfixed image to fix the image on an image bearer such as a paper upon application of pressure and heat is preferably used because its good heat efficiency, simple structure and low production cost.

Particularly, a fixer using a belt-shaped heating medium (hereinafter referred to as a fixing belt) is widely used recently.

The fixing belt can contact the surface of a toner for a long time when fixing and can fix the toner at a lower temperature, and at the same time, toner is melted so much that fusion bonding thereof on the surface of the belt, i.e. an offset phenomenon tends to occur. Particularly, a color toner needs a moderate gloss to appeal sufficient transparency and high grade feeling, and a binder resin needs to have a sharp molecular weight and a sharp-melt property. Therefore, the color toner is melt so much that the offset phenomenon tends to occur.

The fixing belt is mostly an endless belt or a belt with an end formed of a thermostable resin, and mechanical durability thereof should be improved. An external additive and other components of a toner adhere to the belt-shaped heating medium, and which causes an abrasion or a damage thereof, resulting in occurrence of hot offset and a rift of the belt.

Various suggestions have been made to solve the above-mentioned problems as for both of the fixer and toner. Studies and suggestions of only the fixer cannot become an essential solution.

A release agent such as a wax is included in a toner to prevent offset when fixed. However, when a property of the wax and a dispersion status thereof in the toner is unsuitable, the wax is released and from the surface of the toner and exuded thereon after used for long periods in a developing unit. When such a toner is used in a two-component developer, the carrier is contaminated, resulting in deterioration of chargeability of the toner. When used in one-component developer, the wax is fusion bonded to a developing roller and a blade forming a thin layer of the toner, resulting in nonuniform development with the toner. Therefore, a wax is preferably included in a toner in a small amount.

A toner prepared by conventional kneading and pulverization typically has an amorphous shape, a broad particle diameter distribution, a low fluidity, a low transferability, a high fixable temperature, nonuniform charge quantity and a low charged stability. Particularly, the toner has a crack due to the pulverization at an interface of a release agent (wax) and the release agent is present on the surface thereof in a large amount. Therefore, the toner has a sufficient releasability, but the release agent tends to adhere to a carrier, a photoreceptor and a blade.

Japanese Patents Nos. 3413024 and 3397661 and Japanese Laid-Open Patent Publication No. 2002-351143 disclose a method of controlling fixability of a toner by controlling a molecular weight distribution of tetrahydrofuran(THF)-soluble components or a ratio of tetrahydrofuran(THF)-insoluble components. However, particularly a toner including a large amount of crosslinked components does not have satisfactory hot offset resistance, cold offset resistance, fixability and glossiness without producing images having background fouling and contaminating a carrier only by controlling the THF-soluble components.

Because of these reasons, a need exists for a toner having sufficient low-temperature fixability, offset resistance, friction resistance, glossiness without contaminating a fixer and an image even after producing tens of thousands of images.

OBJECTS OF THE INVENTION

Accordingly, an object of the present invention is to provide a toner having sufficient low-temperature fixability, offset resistance, friction resistance, glossiness without contaminating a fixer and an image even after producing tens of thousands of images.

Another object of the present invention is to provide a developer, an image forming apparatus and an image forming method using the toner.

SUMNARY OF THE INVENTION

Briefly these objects and other objects of the present invention as hereinafter will become more readily apparent are attained by a toner including at least a binder resin and a colorant, wherein a hexafluoroisopropanol(HFIP)-soluble component satisfies the following relationship:

$$2{,}000 \leqq Mn \leqq 7{,}000 \text{ and } 1.5 \leqq Mw/Mn \leqq 10$$

wherein Mn represents a number-average molecular weight and Mw represents a weight-average molecular weight.

The toner preferably includes the HFIP-soluble component having a molecular weight not less than 100,000 in an amount of from 0.5 to 18%.

The toner is preferably prepared by a method of dissolving a toner composition including a prepolymer in a solvent to prepare an oil drop; and dispersing the oil drop in an aqueous medium to perform at least one of an elongation reaction and a crosslinking reaction.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
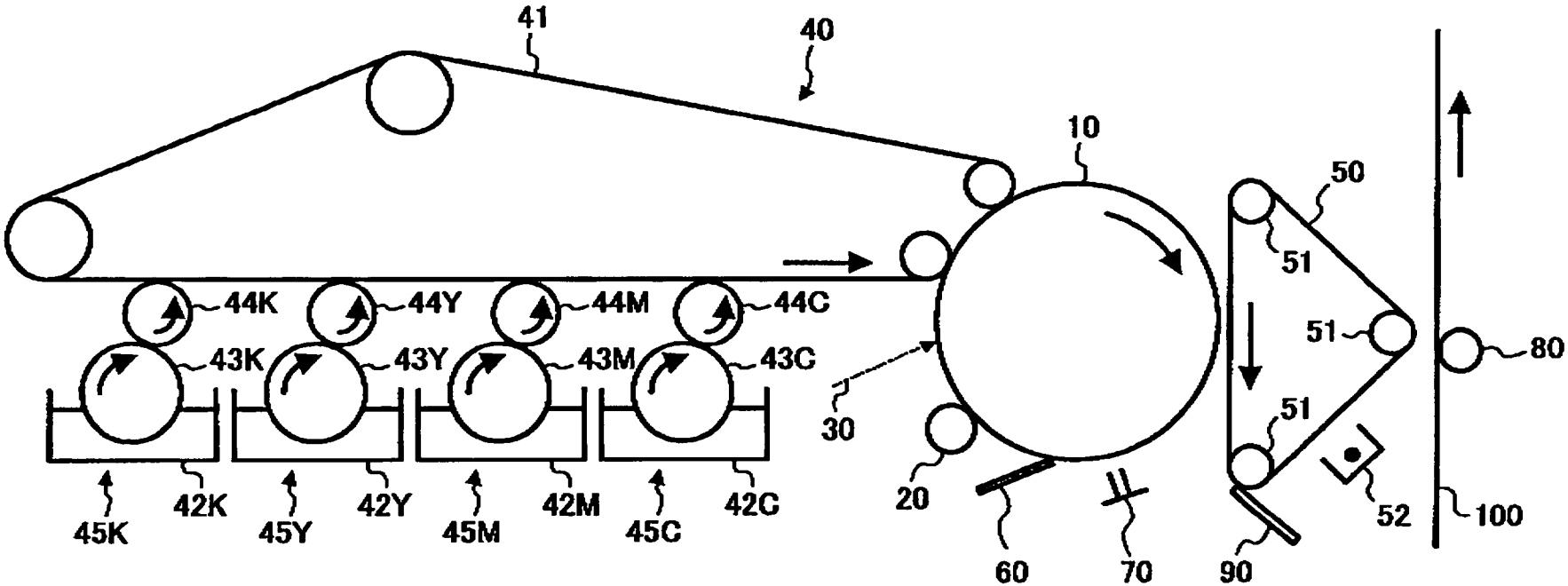
FIG. 1 is a schematic view illustrating an embodiment of a full-color copier using a developing belt.

Generally, the present invention provides a toner having sufficient low-temperature fixability, offset resistance, friction resistance, glossiness without contaminating a fixer and an image even after producing tens of thousands of images.

As a result of keen studies of the present inventors, they discovered that such a toner can be provided when the toner includes at least a binder resin and a colorant, and wherein the hexafluoroisopropanol(HFIP)-soluble component of the toner satisfies the following relationship:

$$2\,000 \leqq Mn \leqq 7{,}000 \text{ and } 1.5 \leqq Mn/Mw \leqq 10$$

wherein Mn represents a number-average molecular weight and Mw represents a weight-average molecular weight.

The reason the invention toner provides good results is not clarified yet, but can be supposed as follows, although the inventors are not bound by any particular theory.

Even a molecular weight distribution of a highly crosslinked (polymer) component can precisely be measured by using HFIP (hexafluoroisopropanol) capable of fully dissolving the highly crosslinked component, which cannot be measured by using a conventional solvent such as tetrahydrofuran (THF).

When Mn is less than 2,000, the resultant toner is less satisfactory with regard to sufficient hot offset resistance and contaminates a carrier. When Mn is greater than 7,000, the resultant toner is less satisfactory with regard to sufficient low-temperature fixability and glossiness. Further, when Mn/Mw is greater than 10, the resultant toner has a broader a molecular weight distribution and is less satisfactory with regard to sufficient low-temperature fixability and glossiness.

A toner satisfying the above-mentioned relationship can be prepared for example by increasing molecular weight (Mn and Mw) of a low-molecular-weight polyester resin before reaction and performing an elongation reaction such that distributions of a highly crosslinked component and a low-molecular-weight component are sharper. A sufficient aging time is effectively given to an elongation reaction of an unreacted monomer and a prepolymer.

Mn is preferably from 2,400 to 12,000, and more preferably from 5,000 to 10,000.

Mw is preferably from 7,000 to 30,000, and more preferably from 9,000 to 20,000.

As mentioned above, by increasing molecular weight (Mn and Mw) of a low-molecular-weight polyester resin before reaction and giving a sufficient aging time to an elongation reaction of an unreacted monomer and a prepolymer, the resultant toner has a higher molecular weight, and the contamination of a fixer and an image can be prevented even after production of tens of thousands of images.

When the toner includes the HFIP-soluble component having a molecular weight not less than 100,000 in an amount of from 0.5 to 18%, the resultant toner has sufficient friction resistance and less fixer contamination and an image even after producing tens of thousands of images.

When the toner is prepared by dissolving a toner composition including a prepolymer in a solvent to prepare an oil drop; and dispersing the oil drop in an aqueous medium to perform an elongation reaction and/or a crosslinking reaction, the resultant toner has sufficient low-temperature fixability, sufficient hot offset resistance and sufficient glossiness.

When the toner includes a polyester resin, the resultant toner has good glossiness, good fixability and good chargeability.

When the toner includes a modified polyester resin, the resultant toner has sufficient low-temperature fixability and sufficient friction resistance.

When the toner has an average circularity of from 0.90 to 0.99, the resultant toner has good low-temperature fixability in a short time.

When the toner has a shape factor SF-1 of from 100 to 150 and a shape factor SF-2 of from 100 to 140, the resultant toner has good low-temperature fixability in a shorter time.

When the toner has a volume-average particle diameter (Dv) of from 2 to 7 μm and a ratio (Dv/Dn) thereof to a number-average particle diameter (Dn) not greater than 1.25, the resultant toner has a uniform fixable temperature and a fixed stability after producing tens of thousands of images, besides good chargeability, good transferability and good fixability, and the capability of producing quality images.

A two-component developer including the toner and a carrier formed of a magnetic particulate material has good low-temperature fixability, good chargeability in a short time and sharp charge quantity distribution without damage to the shape of the toner.

The toner used in an image forming method of using a fixer fixing a toner image on a recording medium upon application of heat with a heating element, at least one heating medium heated thereby and pressurizing member contacting the recording medium to one of the heating medium upon application of pressure, wherein at least one of the heating medium is a belt-shaped heating medium and a predetermined amount of an oil is applied or not applied thereto, has a low-temperature fixability and produces images having stable quality.

In the present invention, the molecular weight distribution of a toner is measured by a GPC (gel permeation chromatography) method under the following conditions.

1. Apparatus: Type 2695 from Waters Corp.
2. Solvent: HFIP+10 mM Sodium trifluoroacetate
3. Column: Shodex HFIP-LG+HFIP-806M×2

4. Temperature: 40° C.
5. Current speed: 0.8 ml/min
6. Sample: After dissolved in the solvent, filtered through a 0.45 μm filter and measured. Concentration is 2 mg/ml and injected amount is 500 μl.
7. Detector: RI detector (RI-88011)

To determine the molecular weight of the sample, a molecular weight calibration curve prepared from a monodisperse polymethylmethacrylate standard sample is used. Sodium trifluoroacetate is preferably included in the solvent as a salt in an amount of 5 to 20 mM to improve the liquidation. When less than 5 mM, the effect is not exerted. When greater than 20 mM, the column is damaged and solubility of the solvent deteriorates. It is preferable that Mn is from 2,000 to 7,000 and Mn/Mw is from 1.5 to 10, and more preferable that Mn is from 3,500 to 6,500, including 2,500, 3000, 4000, 4500, 5000, 5500 and 6000 and Mn/Mw is from 4 to 9 including 2, 3, 5, 6, 7 and 8 to improve low-temperature fix ability and hot offset resistance of the resultant toner. When the toner includes the HFIP-soluble component having a molecular weight not less than 100,000 in an amount of from 0.5 to 18 %, preferably from 1 to 10 %, and more preferably from 1 to 5 %, the resultant toner has sufficient friction resistance and contaminates a fixer less and provides an image even after producing tens of thousands of images It is preferred that the toner of the present invention has a specific shape and a distribution thereof, and preferably has an average circularity of from 0.90 to 0.99. A toner having such an average circularity has a low-temperature fixability in a short time. An amorphous toner having an average circularity less than 0.90 and far from sphericity provides a lesser transferability and image quality. A toner having an average circularity greater than 0.99 can provide lesser cleanability. The shape of the toner is suitably measured by an optical detection method of passing a suspension liquid including a particle through a plate-shaped imaging detector to detect and analyze an image of the particle.

A peripheral length of a circle having an area equivalent to that of a projected image optically detected is divided by an actual peripheral length of the toner particle to determine the circularity of a toner. It is more preferable that the toner has an average circularity of from 0.94 to 0.99 to produce images having good density, reproducibility and high definition. To further improve the cleanability, the toner may preferably have an average circularity of from 0.94 to 0.99 and particles having a circularity less than 0.94 in an amount not greater than 10%.

Specifically, the circularity of the toner is measured by a flow-type particle image analyzer FPIA-2000 from SYSMEX CORPORATION. A specific measuring method includes adding 0.1 to 0.5 ml of a surfactant, preferably an alkylbenzenesulfonic acid, as a dispersant in 100 to 150 ml of water from which impure solid materials are previously removed; adding 0.1 to 0.5 g of the toner in the mixture; dispersing the mixture including the toner with an ultrasonic disperser for 1 to 3 min to prepare a dispersion liquid having a concentration of from 3,000 to 10,000 pieces/μl; and measuring the toner shape and distribution with the above-mentioned measurer.

SF-1 and SF-2 are determined by the following formulae after photographing 300 particles of the toner with an FE-SEM (S-4200) from Hitachi, Ltd. and analyzing the photographed image with an image analyzer Luzex AP from NIRECO Corp through an interface. SF-1 and SF-2 are preferably determined by using the S-4200 and Luzex AP, but are not limited thereto provided similar results can be obtained.

$$SF\text{-}1=(L^2/A)\times(\pi/4)\times 100$$

$$SF\text{-}2=(P^2/A)\times(1/4\pi)\times 100$$

wherein L is the maximum length of a toner; A is a projected area thereof; and P is the maximum peripheral length thereof.

When the toner is a true sphere, both SF-1 and SF-2 are 100. As they become larger than 100, the toner becomes more amorphous than spherical. Particularly, SF-1 represents the whole shape of a toner such as oval or sphere and SF-2 represents a surface concavity and convexity.

SF-1 is preferably from 101 to 150, and more preferably from 101 to 130. SF-2 is preferably from 101 to 140, and more preferably from 101 to 128.

The toner of the present invention preferably has a volume-average particle diameter (Dv) of from 2 to 7 μm, and a ratio (Dv/Dn) to a number-average particle diameter (Dn) not greater than 1.25, and more preferably from 1.10 to 1.25. Such a toner has good thermostable preservability, good low-temperature fixability and good hot offset resistance, and above all has a good glossiness when used in a full-color copier. Further, when used in a two-component developer, a particle diameter fluctuates less even after the toner is consumed and fed for long periods, and the toner has a stable developability even after being stirred in an image developer for long periods. When used as a one-component developer, a particle diameter thereof less fluctuates without filming over a developing roller and fusion bond to a blade forming a thin layer of the toner even after the toner is consumed and fed for long periods. Further, the toner has a good and stable developability even after stirred in an image developer for long periods.

Typically, it is said that the smaller the toner particle diameter, the more advantageous to produce high resolution and quality images. However, the small particle diameter of the toner is disadvantageous thereto to have transferability and cleanability. When the volume-average particle diameter is smaller than 4 μm, the resultant toner in a two-component developer can melt and adhere to a surface of a carrier to deteriorate chargeability thereof when stirred for a long time in an image developer. When the toner is used in a one-component developer, toner filming over a developing roller and fusion bonding of the toner to a blade forming a thin layer thereof can tend to occur.

These phenomena also occur when a content of fine particles in the toner is larger than the scope of the present invention.

When the average particle diameter is larger than the scope of the present invention, the resultant toner may have difficulty in producing high resolution and quality images. In addition, the resultant toner may have a large variation of the particle diameters in many cases after the toner in a developer is consumed and fed for long periods.

When Dv/Dn is greater than 1.25, these phenomena may also occur.

In the present invention, the following modified polyester can be used, among others. For example, a polyester prepolymer having an isocyanate group can be used. The polyester prepolymer (A) is formed from a reaction between polyester having an active hydrogen atom formed by polycondensation between polyol (1) and a polycarboxylic acid (2), and polyisocyanate (3). Specific examples of the groups including the active hydrogen include a hydroxyl group (an alcoholic hydroxyl group and a phenolic hydroxyl group), an amino group, a carboxyl group, a mercapto group, etc. In particular, the alcoholic hydroxyl group is preferably used.

As the polyol (1), diol (1-1) and polyol having 3 valences or more (1-2) can be used, and (1-1) alone or a mixture of (1-1) and a small amount of (1-2) are preferably used. Specific examples of diol (1-1) include alkylene glycol such as ethylene glycol, 1,2-propylene glycol, 1,3-propylene glycol, 1,4-butanediol, and 1,6-hexanediol; alkylene ether glycol such as diethylene glycol, triethylene glycol, dipropylene glycol, polyethylene glycol, polypropylene glycol and polytetramethylene ether glycol; alicyclic diol such as 1,4-cyclohexanedimethanol and hydrogenated bisphenol A; bisphenol such as bisphenol A, bisphenol F and bisphenol S; adducts of the above-mentioned alicyclic diol with an alkylene oxide such as ethylene oxide, propylene oxide and butylene oxide; and adducts of the above-mentioned bisphenol with an alkylene oxide such as ethylene oxide, propylene oxide and butylene oxide.

In particular, alkylene glycol having 2 to 12 carbon atoms and adducts of bisphenol with an alkylene oxide are preferably used, and a mixture thereof is more preferably used. Specific examples of the and polyol having 3 valences or more (1-2) include multivalent aliphatic alcohol having 3 to 8 or more valences such as glycerin, trimethylolethane, trimethylolpropane, pentaerythritol and sorbitol; phenol having 3 or more valences such as trisphenol PA, phenolnovolak, cresolnovolak; and adducts of the above-mentioned polyphenol having 3 or more valences with an alkylene oxide.

As the polycarboxylic acid (2), dicarboxylic acid (2-1) and polycarboxylic acid having 3 or more valences (2-2) can be used, for example, (2-1) alone, or a mixture of (2-1) and a small amount of (2-2) are preferably used. Specific examples of the dicarboxylic acid (2-1) include alkylene dicarboxylic acids such as succinic acid, adipic acid and sebacic acid; alkenylene dicarboxylic acid such as maleic acid and fumaric acid; and aromatic dicarboxylic acids such as phthalic acid, isophthalic acid, terephthalic acid and naphthalene dicarboxylic acid.

In particular, alkenylene dicarboxylic acid having 4 to 20 carbon atoms and aromatic dicarboxylic acid having 8 to 20 carbon atoms are preferably used. Specific examples of the polycarboxylic acid having 3 or more valences (2-2) include aromatic polycarboxylic acids having 9 to 20 carbon atoms such as trimellitic acid and pyromellitic acid. The polycarboxylic acid (2) can be formed from a reaction between the polyol (1) and the above-mentioned acids anhydride or lower alkyl ester such as methyl ester, ethyl ester and isopropyl ester.

The polyol (1) and polycarboxylic acid (2) are mixed such that an equivalent ratio ([OH]/[COOH]) between a hydroxyl group [OH] and a carboxylic group [COOH] is typically from 2/1 to 1/1, preferably from 1.5/1 to 1/1, and more preferably from 1.3/1 to 1.02/1.

Specific examples of the polyisocyanate (3) include aliphatic polyisocyanate such as tetramethylenediisocyanate, hexamethylenediisocyanate and 2,6-diisocyanatemethylcaproate; alicyclic polyisocyanate such as isophoronediisocyanate and cyclohexylmethanediisocyanate; aromatic diisocyanate such as tolylenedisocyanate and diphenylmethanediisocyanate; aroma aliphatic diisocyanate such as $\alpha, \alpha, \alpha', \alpha'$-tetramethylxylylenediisocyanate; isocyanurate; the above-mentioned polyisocyanate blocked with phenol derivatives, oxime and caprolactam; and their combinations.

The polyisocyanate (3) is mixed with polyester such that an equivalent ratio ([NCO]/[OH]) between an isocyanate group [NCO] and polyester having a hydroxyl group [OH] is typically from 5/1 to 1/1, preferably from 4/1 to 1.2/1 and more preferably from 2.5/1 to 1.5/1. When [NCO]/[OH] is greater than 5, low-temperature fixability of the resultant toner deteriorates. When [NCO] has a molar ratio less than 1, a urea content in ester of the modified polyester decreases and hot offset resistance of the resultant toner deteriorates.

A content of the constitutional component of a polyisocyanate in the polyester prepolymer (A) having a polyisocyanate group at its end is from 0.5 to 40% by weight, preferably from 1 to 30% by weight and more preferably from 2 to 20% by weight. When the content is less than 0.5% by weight, hot offset resistance of the resultant toner deteriorates, and in addition, the heat resistance and low-temperature fixability of the toner also deteriorate. In contrast, when the content is greater than 40% by weight, low-temperature fixability of the resultant toner deteriorates.

The number of the isocyanate groups included in a molecule of the polyester prepolymer (A) is at least 1, preferably from 1.5 to 3 on average, and more preferably from 1.8 to 2.5 on average. When the number of the isocyanate group is less than 1 per 1 molecule, the molecular weight of the modified polyester after crosslinked and/or elongated decreases and hot offset resistance of the resultant toner deteriorates.

In the present invention, as a crosslinking and/or elongating agent, amines can be used. Specific examples of the amines (B) include diamines (B1), polyamines (B2) having three or more amino groups, amino alcohols (B3), amino mercaptans (B4), amino acids (B5) and blocked amines (B6) in which the amino groups in the amines (B1) to (B5) are blocked. Specific examples of the diamines (B1) include aromatic diamines such as phenylene diamine, diethyltoluene diamine and 4,4'-diaminodiphenyl methane; alicyclic diamines such as 4,4'-diamino-3,3'-dimethyldicyclohexyl methane, diaminocyclohexane and isophorondiamine; aliphatic diamines such as ethylene diamine, tetramethylene diamine and hexamethylene diamine, etc.

Specific examples of the polyamines (B2) having three or more amino groups include diethylene triamine, triethylene tetramine. Specific examples of the amino alcohols (B3) include ethanol amine and hydroxyethyl aniline. Specific examples of the amino mercaptan (B4) include aminoethyl mercaptan and aminopropyl mercaptan. Specific examples of the amino acids (B5) include amino propionic acid and amino caproic acid. Specific examples of the blocked amines (B6) include ketimine compounds which are prepared by reacting one of the amines (B1) to (B5) with a ketone such as acetone, methyl ethyl ketone and methyl isobutyl ketone; oxazoline compounds, etc. Among these amines (B), diamines (B1) and mixtures in which a diamine is mixed with a small amount of a polyamine (B2) are preferably used.

A molecular weight of the modified polyesters after reaction can optionally be controlled using a crosslinking and/or elongation anticatalyst, if desired. Specific examples of the elongation anticatalyst include monoamines such as diethyle amine, dibutyl amine, butyl amine and lauryl amine, and blocked amines, i.e., ketimine compounds prepared by blocking the monoamines mentioned above.

A mixing ratio (i.e., a ratio [NCO]/[NHx]) of the content of the prepolymer (A) having an isocyanate group to the amine (B) is from 1/2 to 2/1, preferably from 1.5/1 to 1/1.5 and more preferably from 1.2/1 to 1/1.2. When the mixing ratio is greater than 2 or less than 1/2, molecular weight of the modified polyester may decrease, resulting in deterioration of hot offset resistance of the resultant toner.

In the present invention, an unmodified polyester resin (C) can be used in combination with the modified polyester resin (A) as a toner binder resin. It is more preferable to use the unmodified polyester resin (C) in combination with the modified polyester resin than to use the modified polyester resin alone because low-temperature fixability and glossiness of full color images of the resultant toner can improve. Specific examples of the unmodified polyester resin (C) include polycondensated products between the polyol (1) and polycarboxylic acid (2) similarly to the modified polyester resin (A), and products preferably used are the same as those thereof. The unmodified polyester (C) can be substituted with another modified polyester other than a urea-modified polyester, such as a urethane-modified polyester.

It is preferable that the modified polyester resin (A) and unmodified polyester resin (C) are partially soluble each other in terms of the low-temperature fixability and hot offset resistance of the resultant toner. Therefore, the modified polyester resin (A) and unmodified polyester resin (C) preferably have similar compositions. When the unmodified polyester resin (C) is used in combination, a weight ratio ((A)/(C)) between the modified polyester resin (A) and unmodified polyester resin (C) is from 5/95 to 75/25, preferably from 10/90 to 25/75, more preferably from 12/88 to 25/75, and most preferably from 12/88 to 22/78. When the modified polyester resin (A) has a weight ratio less than 5%, the resultant toner has a poor hot offset resistance, and has a difficulty in having a thermostable preservability and a low-temperature fixability.

The unmodified polyester resin (C) preferably has a peak molecular weight of from 1,000 to 30,000, preferably from 1,500 to 10,000, and more preferably from 2,000 to 8,000. When less than 1,000, the thermostable preservability of the resultant toner can deteriorate. When greater than 10,000, the low-temperature fixability thereof can deteriorate. The unmodified polyester resin (C) preferably has a hydroxyl value not less than 5 mg KOH/g, more preferably of from 10 to 120 mg KOH/g, and most preferably from 20 to 80 mg KOH/g. When less than 5, the resultant toner may have difficulty in having thermostable preservability and low-temperature fixability. The unmodified polyester resin (C) preferably has an acid value of from 0.5 to 40 mg KOH/g, and more preferably from 5 to 35 mg KOH/g such that the resultant toner tends to be negatively charged and to have better fixability. When the acid value and hydroxyl value are greater than the maximum value, the resultant toner may be affected by an environment such as an environment of high (low) temperature and high (low) humidity, and may produce poorer quality images.

The toner of the present invention preferably has a glass transition temperature (Tg) of from 40 to 70° C., and more preferably from 45 to 55° C. When less than 40° C., the thermostable preservability of the resultant toner may deteriorate. When greater than 70° C., the low-temperature fixability thereof may be insufficient. The toner of the present invention including the crosslinked and/or elongated polyester resin generally has a better thermostable preservability than known polyester toners even though the glass transition temperature is low. The toner preferably has a temperature (TG') not less than 100° C., and more preferably of from 110 to 200° C. at which a storage modulus of the toner binder resin is 10,000 dyne/cm$^2$ at a measuring frequency of 20 Hz. When less than 100° C., the hot offset resistance of the resultant toner deteriorates.

The toner preferably has a temperature (Tρ) not greater than 180° C., and more preferably of from 90 to 160° C. at which a viscosity is 1,000 poise at a measuring frequency of 20 Hz. When greater than 180° C., the low-temperature fixability of the resultant toner deteriorates. Namely, TG' is preferably higher than Tρ in terms of the low-temperature fixability and hot offset resistance of the resultant toner. In other words, a difference between TG' and Tρ (TG'−Tρ) is preferably not less than 0° C., more preferably not less than 10° C., and furthermore preferably not less than 20° C. A maximum of the difference is not particularly limited. In terms of the thermostable preservability and low-temperature fixability of the resultant toner, the difference between TG' and Tρ (TG'−Tρ) is preferably from 0 to 20° C., more preferably from 10 to 90° C., and most preferably from 20 to 80° C.

Specific examples of the colorants for use in the present invention include any known dyes and pigments such as carbon black, Nigrosine dyes, black iron oxide, Naphthol Yellow S, Hansa Yellow (10G, 5G and G), Cadmium Yellow, yellow iron oxide, loess, chrome yellow, Titan Yellow, polyazo yellow, Oil Yellow, Hansa Yellow (GR, A, RN and R), Pigment Yellow L, Benzidine Yellow (G and GR), Permanent Yellow (NCG), Vulcan Fast Yellow (5G and R), Tartrazine Lake, Quinoline Yellow Lake, Anthrazane Yellow BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, Permanent Red (F2R, F4R, FRL, FRLL and F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazored, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials are used alone or in combination.

A content of the colorant in the toner is not limited and is preferably from 1 to 15% by weight, and more preferably from 3 to 10% by weight, based on total weight of the toner.

The colorant for use in the present invention can be used as a master batch pigment when combined with a resin. Specific examples of the resin for use in the master batch pigment or for use in combination with master batch pigment include the modified and unmodified polyester resins mentioned above; styrene polymers and substituted styrene polymers such as polystyrene, poly-p-chlorostyrene and polyvinyltoluene; styrene copolymers such as styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butylmethacrylate copolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers;

and other resins such as polymethyl methacrylate, polybutylmethacrylate, polyvinyl chloride, polyvinyl acetate, polyethylene, polypropylene, polyesters, epoxy resins, epoxy polyol resins, polyurethane resins, polyamide resins, polyvinyl butyral resins, acrylic resins, rosin, modified rosins, terpene resins, aliphatic or alicyclic hydrocarbon resins, aromatic petroleum resins, chlorinated paraffin, paraffin waxes, etc. These resins are used alone or in combination.

The master batch for use in the toner of the present invention can typically be prepared by mixing and kneading a resin and a colorant upon application of high shear stress thereto. In this case, an organic solvent can be used to heighten the interaction of the colorant with the resin. In addition, flushing methods in which an aqueous paste including a colorant is mixed with a resin solution of an organic solvent to transfer the colorant to the resin solution and then the aqueous liquid and organic solvent are separated and removed can be preferably used because the resultant wet cake of the colorant can be used as it is. Of course, a dry powder which is prepared by drying the wet cake can also be used as a colorant. In this case, a three roll mill is preferably used for kneading the mixture upon application of high shearing stress.

The toner of the present invention may include a wax together with a binder resin and a colorant. Specific examples of the wax include known waxes, e.g., polyolefin waxes such as polyethylene wax and polypropylene wax; long chain carbon hydrides such as paraffin wax and sasol wax; and waxes including carbonyl groups.

Among these waxes, the waxes including carbonyl groups are preferably used. Specific examples thereof include polyesteralkanate such as carnauba wax, montan wax, trimethylolpropanetribehenate, pentaelislitholtetrabehenate, pentaelislitholdiacetatedibehenate, glycerinetribehenate and 1,18-octadecanedioldistearate; polyalkanolesters such as tristearyltrimellitate and distearylmaleate; polyamidealkanate such as ethylenediaminebehenylamide; polyalkylamide such as tristearylamidetrimellitate; and dialkylketone such as distearylketone. Among these waxes including a carbonyl group, polyesteralkanate is preferably used.

The wax for use in the present invention may have a melting point of from 40 to 160° C., preferably of from 50 to 120° C., and more preferably of from 60 to 90° C. A wax having a melting point less than 40° C. has an adverse effect on its high temperature preservability, and a wax having a melting point greater than 160° C. tends to cause cold offset of the resultant toner when fixed at a low temperature. In addition, the wax preferably has a melting viscosity of from 5 to 1,000 cps, and more preferably of from 10 to 100 cps when measured at a temperature higher than the melting point by 20° C. A wax having a melting viscosity greater than 1,000 cps makes it difficult to improve hot offset resistance and low temperature fixability of the resultant toner. A content of the wax in a toner is preferably from 0 to 40% by weight, and more preferably from 3 to 30% by weight.

The toner of the present invention may optionally include a charge controlling agent. Specific examples of the charge controlling agent include any known charge controlling agents such as Nigrosine dyes, triphenylmethane dyes, metal complex dyes including chromium, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid, salicylic acid derivatives, etc.

Specific examples of the marketed products of the charge controlling agents include BONTRON 03 (Nigrosine dyes), BONTRON P-51 (quaternary ammonium salt), BONTRON S-34 (metal-containing azo dye), E-82 (metal complex of oxynaphthoic acid), E-84 (metal complex of salicylic acid), and E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE (triphenyl methane derivative), COPY CHARGE NEG VP2036 and NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments and polymers having a functional group such as a sulfonate group, a carboxyl group, a quaternary ammonium group, etc.

The content of the charge controlling agent can be determined depending on the species of the binder resin used, whether or not an additive is added and toner manufacturing method (such as dispersion method) used, and is not particularly limited. However, the content of the charge controlling agent is typically from 0.1 to 10 parts by weight, and preferably from 0.2 to 5 parts by weight, per 100 parts by weight of the binder resin included in the toner. When the content is too high, the toner can have too large charge quantity, and thereby the electrostatic force of a developing roller attracting the toner increases, possibly resulting in deterioration of the fluidity of the toner and image density of the toner images. These charge controlling agent and release agent can be kneaded upon application of heat together with a master batch pigment and a resin, can be added to toner constituents when dissolved and dispersed in an organic solvent, or can be fixed on the surface of a toner after a toner particle is formed.

As an external additive to subsidize the fluidity, developability and chargeability of a colored particle prepared in the present invention, besides an oxidized particulate material, inorganic particulate material and hydrophobized inorganic particulate material can be used together. It is preferable that the colored particle externally includes at least one hydrophobized inorganic particulate material having an average primary particle diameter of from 1 to 100 nm, and more preferably from 5 to 70 nm. Further, it is more preferable that at least one hydrophobized inorganic particulate material having an average primary particle diameter not greater than 20 nm and an inorganic particulate material having an average primary particle diameter not less than 30 nm. The external additive preferably has a specific surface area of from 20 to 500 $m^2/g$ when measured by a BET method.

Any known inorganic particulate materials and hydrophobized inorganic particulate materials can be used as the external additives. Specific examples of the external additives include silica fine particles, hydrophobized silica, fatty acid metallic salts such as zinc stearate and aluminium stearate, metal oxides such as titania, alumina, tin oxide and antimony oxide, fluoropolymers, etc.

Particularly, the hydrophobized silica, titania and alumina fine particles are preferably used.

Specific examples of the silica fine particles include HDK H 2000, HDK H 2000/4, HDK H 2050EP and HVK 21 from Hoechst AG; and R972, R974, RX200, RY200, R202, R805 and R812 from Nippon Aerosil Co. Specific examples of the titania fine particles include P-25 from Nippon Aerosil Co.; ST-30 and STT-65C-S from Titan Kogyo K. K.; TAF-140 from Fuji Titanium Industry Co., Ltd.; MT150W, MT-500B and MT-600b from Tayca Corp., etc. Specific examples of the hydrophobized titanium oxide fine particles include T-805 from Nippon Aerosil Co.; STT-30A and STT-65S-S from Titan Kogyo K. K.; TAF-500T and TAF-1500T from Fuji Titanium Industry Co., Ltd.; MT-100S and MT100T from Tayca Corp.; IT-S from Ishihara Sangyo Kaisha Ltd., etc.

To prepare the hydrophobized silica fine particles, titania fine particles or alumina fine particles, hydrophilic fine particles are subjected to silane coupling agents such as methyltrimethoxy silane, methyltriethoxy silane and octylmethoxy silane. Inorganic fine particles optionally subjected to a silicone oil upon application of heat is preferably used.

Specific examples of the silicone oil include dimethyl silicone oil, methylphenyl silicone oil, chlorphenyl silicone oil, methylhydrogen silicone oil, alkyl modified silicone oil, fluorine modified silicone oil, polyether modified silicone oil, alcohol modified silicone oil, amino modified silicone oil, epoxy modified silicone oil, epoxy-polyether modified silicone oil, phenol modified silicone oil, carboxyl modified silicone oil, mercapto modified silicone oil, acryl modified silicone oil, methacryl modified silicone oil, α-methylstyrene modified silicone oil, etc.

Specific examples of the inorganic fine particles include silica, alumina, titanium oxide, barium titanate, magnesium titanate, calcium titanate, strontium titanate, zinc oxide, tin oxide, quartz sand, clay, mica, sand-lime, diatomearth, chromium oxide, cerium oxide, red iron oxide, antimonytrioxide, magnesium oxide, zirconium oxide, barium sulfate, barium carbonate, calcium carbonate, silicon carbide, silicon nitride, etc. Particularly, the silica and titanium dioxide are preferably used.

Besides, polymer particulate materials, e.g., polystyrene, ester methacrylate and ester acrylate copolymers formed by soap-free emulsifying polymerization, suspension polymerization and dispersion polymerization; polycondensated particulate materials such as silicone, benzoguanamine and nylon; and polymerized particulate materials formed of thermosetting resins can be used.

Such fluidizers can be surface-treated with a surface treatment agent to increase the hydrophobicity to prevent deterioration of fluidity and chargeability even in an environment of high humidity. Specific examples of the surface treatment agent include a silane coupling agent, a sililating agents a silane coupling agent having an alkyl fluoride group, an organic titanate coupling agent, an aluminium coupling agent a silicone oil and a modified silicone oil.

The toner of the present invention may include a cleanability improver for removing a developer remaining on a photoreceptor and a first transfer medium after transferred. Specific examples of the cleanability improver include fatty acid metallic salts such as zinc stearate, calcium stearate and stearic acid; and polymer particles prepared by a soap-free emulsifying polymerization method such as polymethylmethacrylate particles and polystyrene particles. The polymer particles comparatively have a narrow particle diameter distribution and preferably have a volume-average particle diameter of from 0.01 to 1 μm.

The toner of the present invention may optionally include a particulate resin material. The particulate resin material preferably has a glass transition temperature (Tg) of from 40 to 100° C. and a weight-average molecular weight of from 9,000 to 200,000. When the glass transition temperature (Tg) is less than 40° C. and/or weight-average molecular weight is less than 9,000, storage stability of the resultant toner can deteriorate, and blocking thereof may occur when stored and in an image developer. When the glass transition temperature (Tg) is greater than 100° C. and/or weight-average molecular weight is greater than 200,000, the particulate resin material may impair adherence of the resultant toner to a transfer paper and increase the fixable minimum temperature.

The particulate resin material preferably has a residual ratio of from 0.5 to 5.0% by weight based on total weight of the toner. When less than 0.5% by weight, storage stability of the resultant toner can deteriorate, and blocking thereof may occur when stored and in an image developer. When greater than 5.0% by weight, the particulate resin material can prevent a wax from seeping to impair releasability of the resultant toner, resulting in occurrence of offset.

The residual ratio of the particulate resin material can be determined from a peak area measured by analyzing a material with a pyrolysis gas chromatographic mass analyzer. The mass analyzer is preferably used, but not limited thereto.

Any thermoplastic and thermosetting resins capable of forming an aqueous dispersion can be used as the particulate resin materials. Specific examples of the resins include vinyl resins, polyurethane resins, epoxy resins, polyester resins, polyamide resins, polyimide resins, silicon resins, phenol resins, melamine resins, urea resins, aniline resins, ionomer resins, polycarbonate resins, etc. These can be used alone or in combination. Among these resins, the vinyl resins, polyurethane resins, epoxy resin, polyester resins or combinations of these resins are preferably used because an aqueous dispersion of a fine-spherical particulate resin material can easily be obtained.

Specific examples of the vinyl resins include single-polymerized or copolymerized vinyl monomers such as styrene-ester(metha)acrylate resins, styrene-butadiene copolymers, (metha)acrylic acid-esteracrylate polymers, styrene-acrylonitrile copolymers, styrene-maleic acid anhydride copolymers and styrene-(metha)acrylic acid copolymers.

The toner binder of the present invention can be prepared, for example, by the following method. Polyol (1) and polycarboxylic acid (2) are heated at a temperature of from 150 to 280° C. in the presence of a known catalyst such as tetrabutoxy titanate and dibutyltinoxide. Then water generated is removed, under a reduced pressure if desired, to prepare a polyester resin having a hydroxyl group. Then the polyester resin is reacted with polyisocyanate (3) at a temperature of from 40 to 140° C. to prepare a prepolymer (A) having an isocyanate group.

The toner of the present invention can be prepared by the following method, but the method is not limited thereto.

A particulate resin material is previously added to an aqueous phase. The aqueous phase may include water alone and mixtures of water with a solvent which can be mixed with water. Specific examples of the solvent include alcohols such as methanol, isopropanol and ethylene glycol; dimethylformamide; tetrahydrofuran; cellosolves such as methyl cellosolve; and lower ketones such as acetone and methyl ethyl ketone.

The toner of the present invention can be prepared by reacting a dispersion formed of the prepolymer (A) having an isocyanate group with (B) or by using the modified polyester (i) previously prepared. As a method of stably preparing a dispersion formed of the urea-modified polyester or the prepolymer (A) in an aqueous medium, a method of including toner constituents such as the modified polyester (i) or the prepolymer (A) into an aqueous medium and dispersing them upon application of shear stress is preferably used. The prepolymer (A) and other toner constituents such as colorants, master batch pigments, release agents, charge controlling agents, unmodified polyester resins (LL), etc. may be added into an aqueous medium at the same time when the dispersion is prepared. However, it is preferable that the toner constituents are previously mixed and then the mixed toner constituents are added to the aqueous liquid at the same time. In addition, colorants, release agents, charge controlling agents, etc., are not necessarily added to the aqueous dispersion before particles are formed, and may be added thereto after particles are prepared in the aqueous medium. A method of dyeing particles previously formed without a colorant by a known dying method can also be used.

The dispersion method is not particularly limited, and low speed shearing methods, high-speed shearing methods, friction methods, high-pressure jet methods, ultrasonic methods, etc. can be used. Among these methods, high-speed shearing methods are preferably used because particles having a particle diameter of from 2 to 20 μm can be easily prepared. At this point, the particle diameter (2 to 20 μm) means a particle diameter of particles including a liquid). When a high-speed shearing type dispersion machine is used, the rotation speed is not particularly limited, but the rotation speed is typically from 1,000 to 30,000 rpm, and preferably from 5,000 to 20,000 rpm. The dispersion time is not also particularly limited, but is typically from 0.1 to 5 minutes. The temperature in the dispersion process is typically from 0 to 150° C. (under pressure), and preferably from 40 to 98° C. When the temperature is relatively high, the modified polyester (i) or prepolymer (A) can easily be dispersed because the dispersion formed thereof has a low viscosity.

A content of the aqueous medium to 100 parts by weight of the toner constituents including the modified polyester (i) or prepolymer (A) is typically from 50 to 2,000 parts by weight, and preferably from 100 to 1,000 parts by weight. When the content is less than 50 parts by weight, the dispersion of the toner constituents in the aqueous medium may not be satisfactory, and thereby the resultant mother toner particles may not have a desired particle diameter. In contrast, when the content is greater than 2,000, the production cost increases. A dispersant can preferably be used to prepare a stably dispersed dispersion including particles having a sharp particle diameter distribution.

Specific examples of the dispersants used to emulsify and disperse an oil phase for a liquid including water in which the toner constituents are dispersed include anionic surfactants such as alkylbenzene sulfonic acid salts, α-olefin sulfonic acid salts, and phosphoric acid salts; cationic surfactants such as amine salts (e.g., alkyl amine salts, aminoalcohol fatty acid derivatives, polyamine fatty acid derivatives and imidazoline), and quaternary ammonium salts (e.g., alkyltrimethyl ammonium salts, dialkyldimethyl ammonium salts, alkyldimethyl benzyl ammonium salts, pyridinium salts, alkyl isoquinolinium salts and benzethonium chloride); nonionic surfactants such as fatty acid amide derivatives, polyhydric alcohol derivatives; and ampholytic surfactants such as alanine, dodecyldi(aminoethyl)glycin, di (octylaminoethyle)glycin, and N-alkyl-N,N-dimethylammonium betaine.

A surfactant having a fluoroalkyl group can prepare a dispersion having good dispersibility even when a small amount of the surfactant is used. Specific examples of anionic surfactants having a fluoroalkyl group include fluoroalkyl carboxylic acids having from 2 to 10 carbon atoms and their metal salts, disodium perfluorooctanesulfonylglutamate, sodium 3-{omega-fluoroalkyl(C6-C11)oxy}-1-alkyl(C3-C4)sulfonate, sodium-{omega-fluoroalkanoyl(C6-C8)-N-ethylamino}-1-propane sulfonate, fluoroalkyl(C11-C20)carboxylic acids and their metal salts, perfluoroalkylcarboxylic acids and their metal salts, perfluoroalkyl(C4-C12)sulfonate and their metal salts, perfluorooctanesulfonic acid diethanol amides, N-propyl-N-(2-hydroxyethyl)perfluorooctanesulfone amide, perfluoroalkyl(C6-$C_{10}$)sulfoneamidepropyltrimethylammonium salts, salts of perfluoroalkyl(C6-$C_{10}$)—N-ethylsulfonyl glycin, monoperfluoroalkyl($C_6$-$C_{16}$) ethylphosphates, etc.

Specific examples of the marketed products of such surfactants having a fluoroalkyl group include SURFLON S-111, S-112 and S-113, which are manufactured by Asahi Glass Co., Ltd.; FRORARD FC-93, FC-95, FC-98 and FC-129, which are manufactured by Sumitomo 3M Ltd.; UNIDYNE DS-101 and DS-102, which are manufactured by Daikin Industries, Ltd.; MEGAFACE F-110, F-120, F-113, F-191, F-812 and F-833 which are manufactured by Dainippon Ink and Chemicals, Inc.; ECTOP EF-102, 103, 104, 105, 112, 123A, 306A, 501, 201 and 204, which are manufactured by Tohchem Products Co., Ltd.; FUTARGENT F-100 and F150 manufactured by Neos; etc.

Specific examples of the cationic surfactants, which can disperse an oil phase including toner constituents in water, include primary, secondary and tertiary aliphatic amines having a fluoroalkyl group, aliphatic quaternary ammonium salts such as erfluoroalkyl(C6-C10)sulfoneamidepropyltrimethylammonium salts, benzalkonium salts, benzetonium chloride, pyridinium salts, imidazolinium salts, etc. Specific examples of the marketed products thereof include SURFLONS-121 (from Asahi Glass Co., Ltd.); FRORARD FC-135 (from Sumitomo 3M Ltd.); UNIDYNE DS-202 (from Daikin Industries, Ltd.); MEGAFACE F-150 and F-824 (from Dainippon Ink and Chemicals, Inc.); ECTOP EF-132 (from Tohchem Products Co., Ltd.); FUTARGENT F-300 (from Neos); etc.

In addition, inorganic compound dispersants such as tricalcium phosphate, calcium carbonate, titanium oxide, colloidal silica and hydroxyapatite which are hardly insoluble in water can also be used.

Further, it is possible to stably disperse toner constituents in water using a polymeric protection colloid. Specific examples of such protection colloids include polymers and copolymers prepared using monomers such as acids (e.g., acrylic acid, methacrylic acid, α-cyanoacrylic acid, α-cyanomethacrylic acid, itaconic acid, crotonic acid, fumaric acid, maleic acid and maleic anhydride), acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g, acrylamide, methacrylamide and diacetoneacrylamide) and their methylol compounds, acid chlorides (e.g., acrylic acid chloride and methacrylic acid chloride), and monomers having a nitrogen atom or an alicyclic ring having a nitrogen atom (e.g., vinyl pyridine, vinyl pyrrolidone, vinyl imidazole and ethylene imine). In addition, polymers such as polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters); and cellulose compounds such as methyl cellulose, hydroxyethyl cellulose and hydroxypropyl cellulose, can also be used as the polymeric protective colloid.

When an acid such as calcium phosphate or a material soluble in alkaline is used as a dispersant, the calcium phosphate is dissolved with an acid such as a hydrochloric acid and washed with water to remove the calcium phosphate from the toner particle. Besides this method, it can also be removed by an enzymatic hydrolysis. When a dispersant is used, the dispersant may remain on a surface of the toner particle. However, the dispersant is preferably washed and removed after the elongation and/or crosslinking reaction of the prepolymer with amine.

The elongation and/or crosslinking reaction time depend on reactivity of an isocyanate structure of the prepolymer (A) and amine (B), but is typically from 10 min to 40 hrs, and preferably from 2 to 24 hrs. The reaction temperature is typically from 0 to 150° C., and preferably from 40 to 98° C. In addition, a known catalyst such as dibutyltinlaurate and dioctyltinlaurate can be used.

To remove an organic solvent from the emulsified dispersion, a method of gradually raising a temperature of the whole dispersion to completely remove the organic solvent in the droplet by vaporizing can be used. Otherwise, a method of spraying the emulsified dispersion in a dry air, completely removing a water-insoluble organic solvent in the droplet to form toner particles and removing a water dispersant by vaporizing can also be used. As the dry air, an atmospheric air, a nitrogen gas, carbon dioxide gas, a gaseous body in which a combustion gas is heated, and particularly various aerial currents heated to have a temperature not less than a boiling point of a solvent used are typically used. A spray dryer, a belt dryer and a rotary kiln can sufficiently remove the organic solvent in a short time.

In addition, a method of blowing air with a rotary evaporator to remove the organic solvent can also be used.

Then, the emulsified dispersion is roughly separated with a centrifugal separator, and repeatedly washed in a washing tank and dried with a hot air drier to prepare a mother toner. Then, an aging process is preferably included to control a hollow status in the toner. The aging process is preferably performed at 30 to 55° C., and more preferably at 40 to 50° C. for 5 to 36 hrs, and more preferably for 10 to 24 hrs.

When the emulsified dispersion is washed and dried while maintaining a wide particle diameter distribution thereof, the dispersion can be classified to have a desired particle diameter distribution.

A cyclone, a decanter, a centrifugal separation, etc. can remove particles in a dispersion liquid. A powder after the dispersion liquid is dried can be classified, but the liquid is preferably classified in terms of efficiency. Unnecessary fine and coarse particles can be recycled to a kneading process to form particles. The fine and coarse particles may be wet when recycled.

A dispersant is preferably removed from a dispersion liquid, and more preferably removed at the same time when the above-mentioned classification is performed.

Heterogeneous particles such as release agent particles, charge controlling particles, fluidizing particles and colorant particles can be mixed with a toner powder after dried. Release of the heterogeneous particles from composite particles can be prevented by giving a mechanical stress to a mixed powder to fix and fuse them on a surface of the composite particles.

Specific methods include a method of applying an impact strength on a mixture with a blade rotating at a high-speed, a method of putting a mixture in a high-speed stream and accelerating the mixture such that particles thereof collide each other or composite particles thereof collide with a collision board, etc. Specific examples of the apparatus include an ONG MILL from Hosokawa Micron Corp., a modified I-type mill having a lower pulverizing air pressure from Nippon Pneumatic Mfg. Co., Ltd., a hybridization system from Nara Machinery Co., Ltd., a Kryptron System from Kawasaki Heavy Industries, Ltd., an automatic mortar, etc.

Finally, an external additive such as an inorganic particulate material and the mother toner are mixed by a HENSCHEL mixer and coarse toner particles are removed by a ultrasonic sifter to prepare a final toner.

The toner of the present invention can be used for a two-component developer in which the toner is mixed with a magnetic carrier. A content of the toner is preferably from 1 to 10 parts by weight per 100 parts by weight of the carrier. Suitable carriers for use in the two component developer include known carrier materials such as iron powders, ferrite powders, magnetite powders, magnetic resin carriers, which have a particle diameter of from about 20 to about 200 μm. The carrier may be coated by a resin. Specific examples of such resins to be coated on the carriers include amino resins such as urea-formaldehyde resins, melamine resins, benzoguanamine resins, urea resins, and polyamide resins, and epoxy resins.

In addition, vinyl or vinylidene resins such as acrylic resins, polymethylmethacrylate resins, polyacrylonitirile resins, polyvinyl acetate resins, polyvinyl alcohol resins, polyvinyl butyral resins, polystyrene resins, styrene-acrylic copolymers, halogenated olefin resins such as polyvinyl chloride resins, polyester resins such as polyethyleneterephthalate resins and polybutyleneterephthalate resins, polycarbonate resins, polyethylene resins, polyvinyl fluoride resins, polyvinylidene fluoride resins, polytrifluoroethylene resins, polyhexafluoropropylene resins, vinylidenefluoride-acrylate copolymers, vinylidenefluoride-vinylfluoride copolymers, copolymers of tetrafluoroethylene, vinylidenefluoride and other monomers including no fluorine atom, and silicone resins.

An electroconductive powder may optionally be included in the toner. Specific examples of such electroconductive powders include metal powders, carbon blacks, titanium oxide, tin oxide, and zinc oxide. The average particle diameter of such electroconductive powders is preferably not greater than 1 μm. When the particle diameter is too large, it can be hard to control the resistance of the resultant toner.

The toner of the present invention can also be used as a one-component magnetic or non-magnetic developer without a carrier.

In the present invention, an intermediate transferer can be used. FIG. 1 is a schematic view illustrating an embodiment of a full-color copier using a developing belt. Around a photoreceptor drum (hereinafter referred to as a photoreceptor) as an image bearer 10, a charging roller as a charger 20, an irradiator 30, a cleaner having a cleaning blade 60, a discharge lamp as a discharger 70, an image developer 40 and a intermediate transferer 50 are arranged. The intermediate transferer 50 is suspended by plural suspension rollers 51 and endlessly driven by a driver such as motor (not shown) in a direction indicated by an arrow. Some of the suspension rollers 51 are combined with roles of transfer bias rollers feeding a transfer bias to the intermediate transferer and a predetermined transfer bias is applied thereto from an electric source (not shown). A cleaner having a cleaning blade 90 cleaning the intermediate transferer 50 is also arranged. A transfer roller 80 transferring a toner image onto a transfer paper 100 as a final transferer is arranged facing the intermediate transferer 50, to which a transfer bias is applied from an electric source (not shown). Around the intermediate transferer 50, a corona charger 52 is arranged as a charger.

The image developer 40 includes a developing belt 41 as a developer bearer, a black (Bk) developing unit 45K, a yellow (Y) developing unit 45Y, a magenta (M) developing unit 45M and a cyan (C) developing unit 45C around the developing belt 41. The developing belt 41 is extended over plural belt rollers, endlessly driven by a driver such as motor (not shown) in a direction indicated by an arrow and driven at almost a same speed as the photoreceptor 10 at a contact point therewith.

Since each developing unit has a same configuration, only Bk developing unit 50Bk will be explained, and explanations of other developing units 50Y, 50M and 50C are omitted.

The developing unit 50Bk includes a developer tank 42Bk including a high-viscosity and high-concentration liquid developer including a toner and a carrier liquid, a scoop roller 43Bk with a bottom dipped in the liquid developer in the developer tank 42Bk and an application roller 44Bk applying a thin layer of the developer scooped by the scoop roller 43Bk to the developing belt 41. The application roller 44Bk has an electroconductivity and a predetermined bias is applied thereto from an electric source (not shown).

Figure 2:
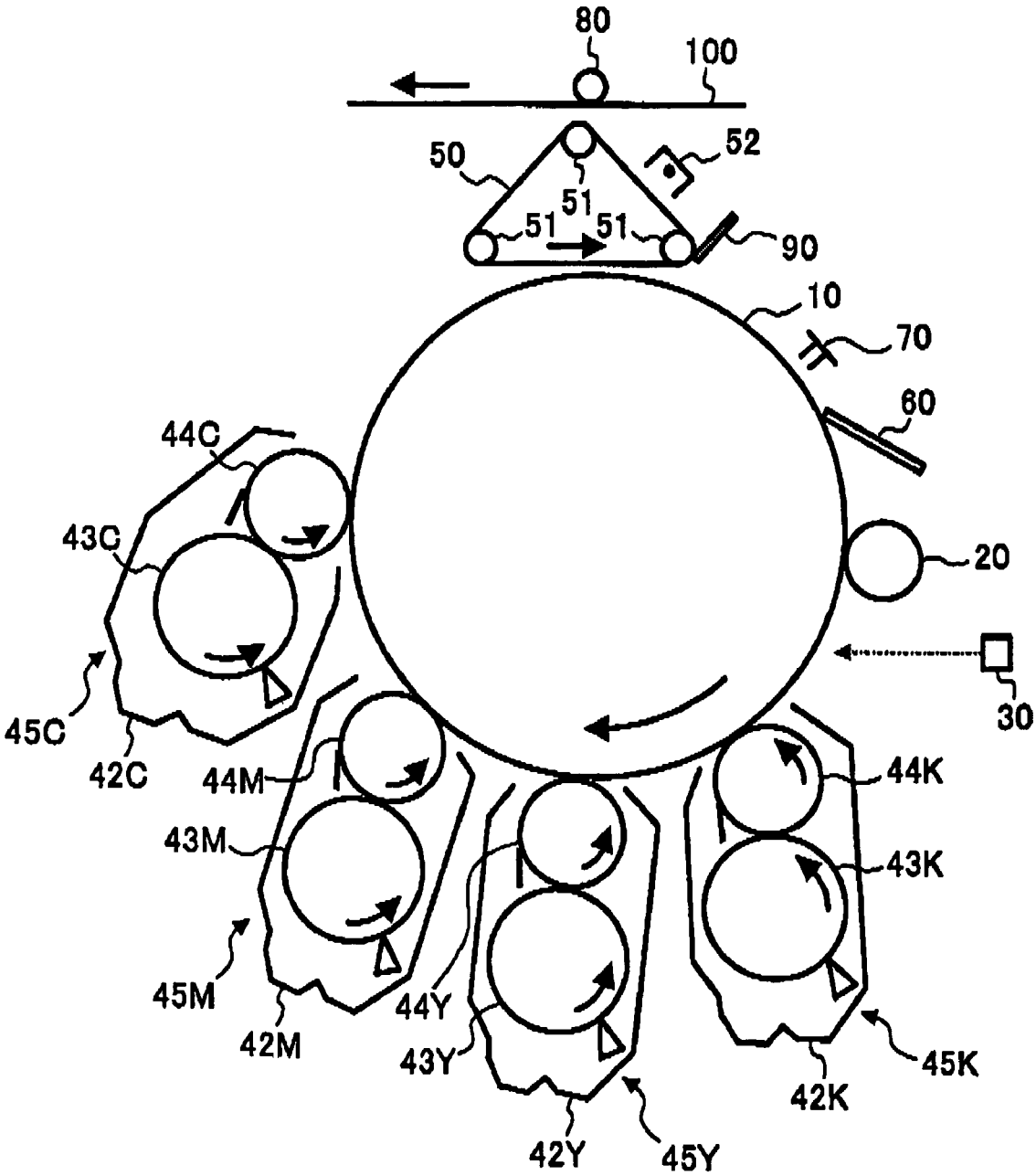
FIG. 2 is a schematic view illustrating an embodiment of a full-color copier equipped with developing units for each color around a photoreceptor.

In the present invention, besides the embodiment of a full-color copier in FIG. 1, an embodiment of a full-color copier in FIG. 2 wherein developing units 45 for each color are located around a photoreceptor 10 can be used.

In FIG. 1, after the photoreceptor 10 is uniformly charged rotating in a direction indicated by an arrow, the irradiator 30 irradiates the photoreceptor 10 with an original imagewise light from an optical system (not shown) to form an electrostatic latent image thereon. The electrostatic latent image is developed by the image developer 40 to form a visual toner image thereon. The developer thin layer on the developing belt 41 is released therefrom as it is and transferred onto a part the electrostatic latent image is formed on. The toner image developed by the image developer 40 is transferred onto the surface of the intermediate transferer 50 (first transfer) driven at a same speed as that of the photoreceptor 10 at a contact point (first transfer area) therewith. When 3 or 4 colors are overlaid on the intermediate transferer 50 to form a full-color image thereon.

In the rotating direction of the intermediate transferer 50, the corona charger 52 charging the toner image thereon is located in a downstream of the contact point between the photoreceptor 10 and the intermediate transferer 50, and in an upstream of a contact point between the intermediate transferer 50 and the transfer paper 100. The corona charger 52 applies a sufficient charge having a same polarity as that of the toner particle to the toner image so as to be transferred well onto the transfer paper 100. After the toner image is charged by the corona charger 52, the toner image is transferred at a time by a transfer bias from the transfer roller 80 onto the transfer paper 100 fed from a paper feeder (not shown) in a direction indicated by an arrow. Then, the transfer paper 100 the toner image is transferred onto is separated from the photoreceptor 10 by a separator (not shown). After the toner image is fixed thereon by a fixer (not shown), the transfer paper 100 is discharged from the copier. On the other hand, untransferred toner is removed from the photoreceptor 10 by a cleaner 60 after the toner image is transferred, and discharged by the discharge lamp 70 to be ready for the following charge.

The intermediate transferer preferably has a static friction coefficient of from 0.1 to 0.6, and more preferably from 0.3 to 0.5. In addition, the intermediate transferer preferably has a volume resistance of from several to $10^3$ Ω cm. When the intermediate transferer has a volume resistance of from several to $10^3$ Ω cm, it helps prevent the phenomenon that the intermediate transferer itself is charged and a charge is difficult to remain thereon to prevent an uneven second transfer. Further, a transfer bias can easily be applied thereto.

Materials therefor are not limited and any known materials can be used. Specific examples thereof include:

(1) a single layer belt formed of a material having high Young's modulus (tensile elasticity) such as PC (polycarbonate), PVDF (polyvinylidenefluoride), PAT (polyalkyleneterephthalate), a mixture of PC and PAT, a mixture of ETFE (ethylenetetrafluoroethylene copolymer) and PC, a mixture of ETFE and PAT, a mixture of PC and PAT and a thermosetting polyimide in which carbon black dispersed, which has a small transformed amount against a stress when an image is formed;

(2) a two or three layer belt including a surface layer or an intermediate layer based on the above-mentioned belt having high Young's modulus, which prevents hollow line images due to a hardness of the single layer belt; and (3) a belt formed of a rubber and an elastomer having comparatively a low Young's modulus, which has an advantage of scarcely producing hollow line images due to its softness, and being low-cost because of not needing a rib or a meandering inhibitor when the belt is wider than a driving roller and an extension roller such that an elasticity of an edge of the belt projecting therefrom prevents the meandering.

The intermediate transfer belt is conventionally formed of a fluorocarbon resin, a polycarbonate resin and a polyimide resin. However, an elastic belt which is wholly or partially an elastic member is used recently.

A full-color image is typically formed of 4 colored toners. The full-color image includes 1 to 4 toner layers. The toner layer receives a pressure from a first transfer (transfer from a photoreceptor to an intermediate transfer belt) and a second transfer (from the intermediate transfer belt to a sheet), and agglutinability of the toner increases, resulting in production of hollow letter images and edgeless solid images. Since a resin belt has a high hardness and does not transform according to a toner layer, it tends to compress the toner layer, resulting in production of hollow letter images.

Recently, demands for forming an image on various sheets such as a Japanese paper and a sheet purposefully having a concavity and convexity are increasing. However, a paper having a poor smoothness tends to have an air gap with a toner when transferred thereon and hollow images tend to be produced thereon. When a transfer pressure of the second transfer is increased to increase an adhesion of the toner to the paper, agglutinability of the toner increases, resulting in production of hollow letter images.

The elastic belt transforms according to a toner layer and a sheet having a poor smoothness at a transfer point. Since the elastic belt transforms following to a local concavity and convexity, it adheres a toner to a paper well without giving an excessive transfer pressure to a toner layer, and therefore a transfer image having good uniformity can be formed even on a sheet having a poor smoothness without hollow letter images.

Specific examples of the resin for the elastic belt include polycarbonate; fluorocarbon resins such as ETFE and PVDF; styrene resins (polymers or copolymers including styrene or a styrene substituent) such as polystyrene, chloropolystyrene, poly-α-methylstyrene, a styrene-butadiene copolymer, a styrene-vinylchloride copolymer, a styrene-vinylacetate copolymer, a styrene-maleate copolymer, a styrene-esteracrylate copolymer (a styrene-methylacrylate copolymer, a styrene-ethylacrylate copolymer, a styrene-butylacrylate copolymer, a styrene-octylacrylate copolymer and a styrene-phenylacrylate copolymer), a styrene-estermethacrylate copolymer (a styrene-methylmethacrylate copolymer, a styrene-ethylmethacrylate copolymer and a styrene-phenylmethacrylate copolymer), a styrene-α-methylchloroacrylate copolymer and a styrene-acrylonitrile-esteracrylate copolymer; a methylmethacrylate resin; a butyl methacrylate resin; an ethyl acrylate resin; a butyl acrylate resin; a modified acrylic resin such as a silicone-modified acrylic resin, a vinylchloride resin-modified acrylic resin and an acrylic urethane resin; a vinylchloride resin; a styrene-vinylacetate copolymer; a vinylchloride-vinyl-acetate copolymer; a rosin-modified maleic acid resin; a phenol resin; an epoxy resin; a polyester resin; a polyester polyurethane resin; polyethylene; polypropylene; polybutadiene; polyvinylidenechloride; an ionomer resin; a polyurethane resin; a silicone resin; a ketone resin; an ethylene-ethylacrylate copolymer; a xylene resin; a polyvinylbutyral resin; a polyamide resin; a modified-polyphenyleneoxide resin, etc. These can be used alone or in combination. However, these are not limited thereto.

Specific examples of an elastic rubber and an elastomer include a butyl rubber, a fluorinated rubber, an acrylic rubber, EPDM, NBR, an acrylonitrile-butadiene-styrene natural rubber, an isoprene rubber, a styrene-butadiene rubber, a butadiene rubber, an ethylene-propylene rubber, an ethylene-propylene terpolymer, a chloroprene rubber, chlolosulfonated polyethylene, chlorinated polyethylene, a urethane rubber, syndiotactic 1,2-polybutadiene, an epichlorohydrin rubber, a silicone rubber, a fluorine rubber, a polysulfide rubber, a polynorbornene rubber, a hydrogenated nitrile rubber; and a thermoplastic elastomer such as a polystyrene elastomer, a polyolefin elastomer, a polyvinylchloride elastomer, a polyurethane elastomer, a polyamide elastomer, a polyurea elastomer, a polyester elastomer and a fluorocarbon resin elastomer; etc. These can be used alone or in combination. However, these are not limited thereto.

Specific examples of a conductant controlling a resistivity include a metallic powder such as carbon black, graphite, aluminium and nickel; and an electroconductive metal oxide such as a tin oxide, a titanium oxide, a antimony oxide, an indium oxide, kalium titanate, an antimony oxide-tin oxide complex oxide and an indium oxide-tin oxide complex oxide. The electroconductive metal oxide may be coated with an insulative particulate material such as barium sulfate, magnesium silicate and calcium carbonate. These are not limited thereto.

A surface layer material of the elastic material does not contaminate photoreceptor and decrease surface friction of a transfer belt to increase cleanability and second transferability of a toner. For example, one, or two or more of a polyurethane resin, a polyester resin and an epoxy resin can reduce a surface energy and increase a lubricity. A powder or a particulate material of one, or two or more of a fluorocarbon resin, a fluorine compound, fluorocarbon, a titanium dioxide, silicon carbide can be also used. A material having a surface layer including many fluorine atoms when heated, and having a small surface energy such as a fluorinated rubber can also be used.

The belt can be prepared by the following methods, but the methods are not limited thereto and the belt is typically prepared by combinations of plural methods.

(1) A centrifugal forming method of feeding materials into a rotating cylindrical mold.

(2) A spray coating method of spraying a liquid coating to form a film.

(3) A dipping method of dipping a cylindrical mold in a material solution.

(4) A casting method of casting materials into an inner mold and an outer mold.

(5) A method of winding a compound around a cylindrical mold to perform a vulcanizing grind.

As a method of preventing an elongation of the elastic belt, a method of forming a rubber layer on a resin layer having a hard center with less elongation and a method of including an elongation inhibitor in a layer having a hard center are used.

Specific examples of the elongation inhibitor include a natural fiber such as cotton and silk; a synthetic fiber such as a polyester fiber, a nylon fiber, an acrylic fiber, a polyolefin fiber, a polyvinylalcohol fiber, a polyvinylchloride fiber, a polyvinylidenechloride fiber, a polyurethane fiber, a polyacetal fiber, a polyfluoroethylene fiber and a phenol fiber; an inorganic fiber such as a carbon fiber, a glass fiber and a boron fiber; and a metallic fiber such as an iron fiber and a copper fiber. These can be used alone or in combination in form of a fabric or a filament. However, these are not limited thereto.

Any twisting methods such as twisted one or plural filaments, a piece twist yarn, a ply yarn and two play yarn can be used. The filament can be subject to an electroconductive treatment.

Any fabrics such as a knitted fabric and a mixed weave fabric can be used, and can be subject to an electroconductive treatment.

Specific examples of a method of preparing a layer having a hard center include a method of covering a cylindrically-woven fabric over a metallic mold and forming a coated layer thereon; a dipping a cylindrically-woven fabric in a liquid rubber and forming a coated layer on one side or both sides thereof; and a method of spirally winding a thread around a metallic mold and forming a coated layer thereon.

When the elastic layer is too thick, expansion and contraction of the surface becomes large and tends to have a crack, although depending on a hardness thereof. When the expansion and contraction of the surface becomes large, the resultant image largely expands and contracts. Therefore, it is not preferable that the elastic layer is too thick, but it preferably has a thickness not less than 1 mm.

Figure 3:
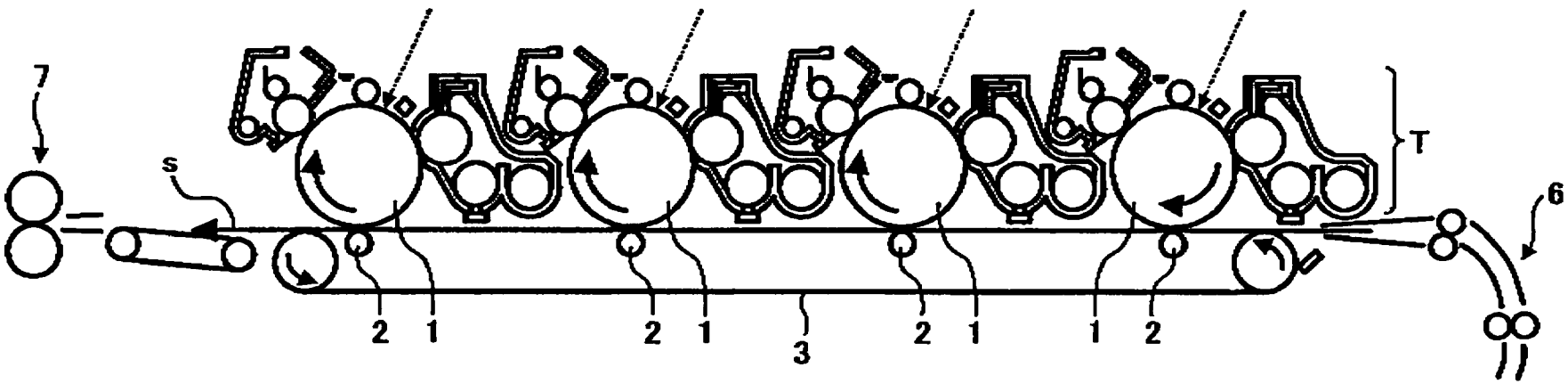
FIG. 3 is a schematic view illustrating an embodiment of a tandem-type electrophotographic image forming apparatus.

A tandem-type electrophotographic image forming apparatus includes an apparatus using a direct transfer method of sequentially transferring an image on each photoreceptor 1 with a transferer 2 onto a sheet s fed by a sheet feeding belt 3 as shown in FIG. 3, and an apparatus using an indirect transfer method of sequentially transferring an image on each photoreceptor 1 with a first transferer 2 onto an intermediate transferer 4 and transferring the image thereon onto a sheet s with a second transferer 5. The second transferer 5 has the shape of a belt, and may have the shape of a roller.

The direct transfer method has a disadvantage of being large toward a sheet feeding direction because a paper feeder 6 is located in an upstream of a tandem-type image forming apparatus T having photoreceptors 1 in line, and a fixer 7 in a downstream thereof.

The indirect method can be downsized because of being able to freely locate the second transferer, and can locate a paper feeder 6 and a fixer 7 together with a tandem-type image forming apparatus T.

To avoid being large toward a sheet feeding direction, the former method locates the fixer 7 close to the tandem-type image forming apparatus T. Therefore, the sheet s cannot flexibly enter the fixer 7, and an impact thereof to the fixer 7 when entering the fixer 7 and a difference of feeding speed of the sheet s between when passing through the fixer 7 and when fed by a feeding belt tend to affect an image formation in the upstream.

The latter method can flexibly locate the fixer 7, and therefore the fixer 7 scarcely affects the image formation.

Therefore, recently, the tandem-type electrophotographic image forming apparatus using an indirect transfer method is widely used.

Figure 4:
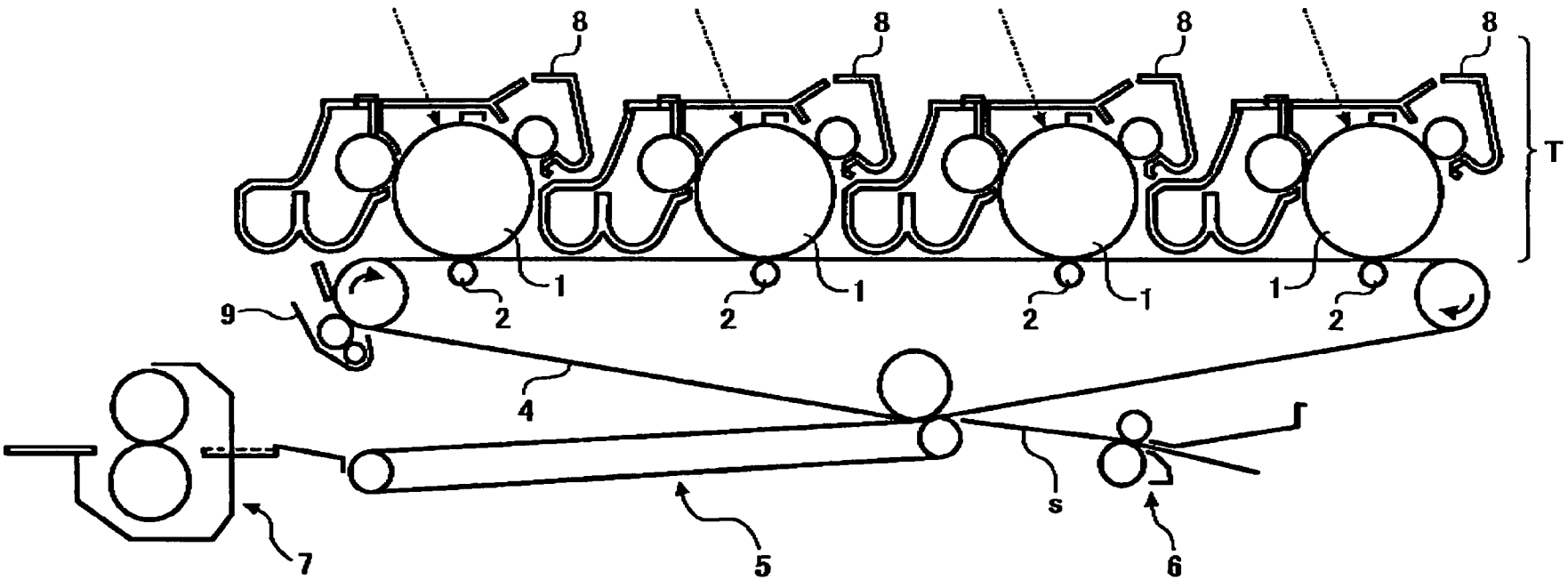
FIG. 4 is a schematic view illustrating an embodiment of a tandem-type electrophotographic image forming apparatus using an intermediate transferer.

In this type of full-color electrophotographic image forming apparatus, as shown in FIG. 4, a photoreceptor cleaner 8 removes a residual toner on a photoreceptor 1 to clean the surface thereof after a first transfer and ready for another image formation. In addition, an intermediate transferer cleaner 9 removes a residual toner on an intermediate transferer 4 to clean the surface thereof after second transfer and ready for another image formation.

Figure 5:
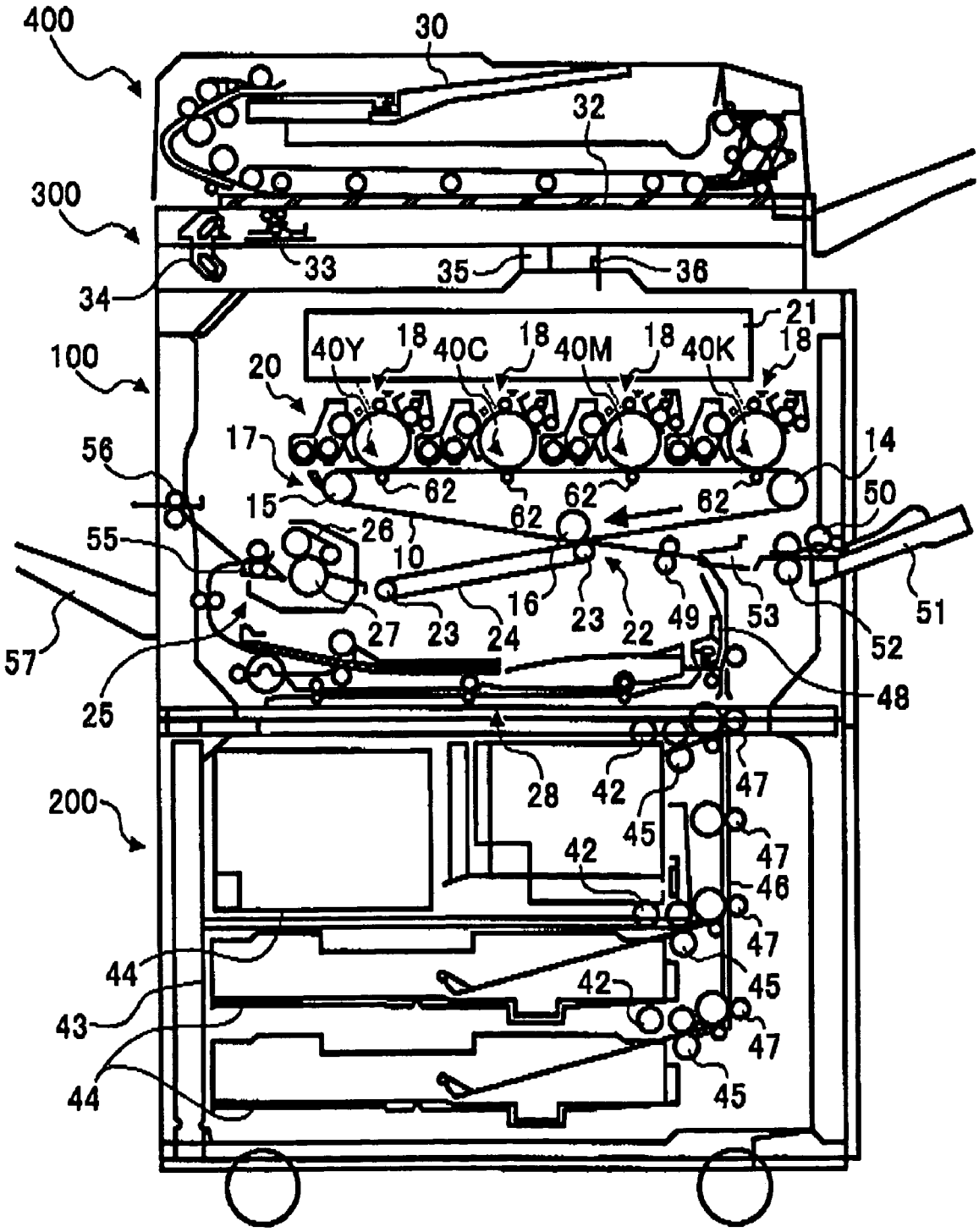
FIG. 5 is a schematic view illustrating an embodiment of a tandem-type electrophotographic image forming apparatus using an indirect transferer.

FIG. 5 is a schematic view illustrating an embodiment of a tandem-type electrophotographic image forming apparatus using an indirect transferer. Numeral 100 is a copier, 200 is a paper feeding table, 300 is a scanner on the copier 100 and 400 is an automatic document feeder (ADF) on the scanner 300. The copier 100 includes an intermediate transferer 10 having the shape of an endless belt.

The intermediate transferer 10 is suspended by three suspension rollers 14, 15 and 16 and rotatable in a clockwise direction. On the left of the suspension roller 15, an intermediate transferer cleaner 17 is located to remove a residual toner on an intermediate transferer 10 after an image is transferred.

Above the intermediate transferer 10, 4 image forming units 18 for yellow, cyan, magenta and black colors are located in line from left to right along a transport direction of the intermediate transferer 10 to form a tandem image forming apparatus 20.

Above the tandem image forming apparatus 20, an image developer 21 is located. On the opposite side of the tandem image forming apparatus 20 across the intermediate transferer 10, a second transferer 22 is located. The second transferer 22 includes a an endless second transfer belt 24 and two rollers 23 suspending the endless second transfer belt 24, and is pressed against the suspension roller 16 across the intermediate transferer 10 and transfers an image thereon onto a sheet.

Beside the second transferer 22, a fixer 25 fixing a transferred image on the sheet is located. The fixer 25 includes an endless belt 26 and a pressure roller 27 pressed against the belt.

The second transferer 22 also includes a function of transporting the sheet an image is transferred on to the fixer 25. As the second transferer 22, a transfer roller and a non-contact charger may be used. However, they are difficult have such a function of transporting the sheet.

In FIG. 5, below the second transferer 22 and the fixer 25, a sheet reverser 28 reversing the sheet to form an image on both sides thereof is located in parallel with the tandem image forming apparatus 20.

An original is set on a table 30 of the ADF 400 to make a copy, or on a contact glass 32 of the scanner 300 and pressed with the ADF 400.

When a start switch (not shown) is put on, a first scanner 33 and a second scanner 34 scans the original after the original set on the table 30 of the ADF 400 is fed onto the contact glass 32 of the scanner 300, or immediately when the original set thereon. The first scanner 33 emits light to the original and reflects reflected light therefrom to the second scanner 34. The second scanner further reflects the reflected light to a reading sensor 36 through an imaging lens 35 to read the original.

When a start switch (not shown) is put on, a drive motor (not shown) rotates one of the suspension rollers 14, 15 and 16 such that the other two rollers are driven to rotate, to rotate the intermediate transferer 10. At the same time, each of the image forming units 18 rotates the photoreceptor 40 and forms a single-colored image, i.e., a black image, a yellow image, a magenta image and cyan image on each photoreceptor 40. The single-colored images are sequentially transferred onto the intermediate transferer 10 to form a full-color image thereon.

On the other hand, when start switch (not shown) is put on, one of paper feeding rollers 42 of paper feeding table 200 is selectively rotated to take a sheet out of one of multiple-stage paper cassettes 44 in a paper bank 43. A separation roller 45 separates sheets one by one and feed the sheet into a paper feeding route 46, and a feeding roller 47 feeds the sheet into a paper feeding route 48 of the copier 100 to be stopped against a resist roller 49.

Otherwise, a paper feeding roller 50 is rotated to take a sheet out of a manual feeding tray 51, and a separation roller 52 separates sheets one by one and feed the sheet into a paper feeding route 53 to be stopped against a resist roller 49.

Then, in timing with a synthesized full-color image on the intermediate transferer 10, the resist roller 49 is rotated to feed the sheet between the intermediate transferer 10 and the second transferer 22, and the second transferer transfers the full-color image onto the sheet.

The sheet the full-color image is transferred thereon is fed by the second transferer 22 to the fixer 25. The fixer 25 fixes the image thereon upon application of heat and pressure, and the sheet is discharged by a discharge roller 56 onto a catch tray 57 through a switch-over click 55. Otherwise, the switch-over click 55 feeds the sheet into the sheet reverser 28 reversing the sheet to a transfer position again to form an image on the backside of the sheet, and then the sheet is discharged by the discharge roller 56 onto the catch tray 57.

On the other hand, the intermediate transferer 10 after transferring an image is cleaned by the intermediate transferer cleaner 17 to remove a residual toner thereon after the image is transferred, and ready for another image formation by the tandem image forming apparatus 20.

The resist roller 49 is typically grounded, and a bias may be applied thereto remove paper dust from the sheet.

Figure 6:
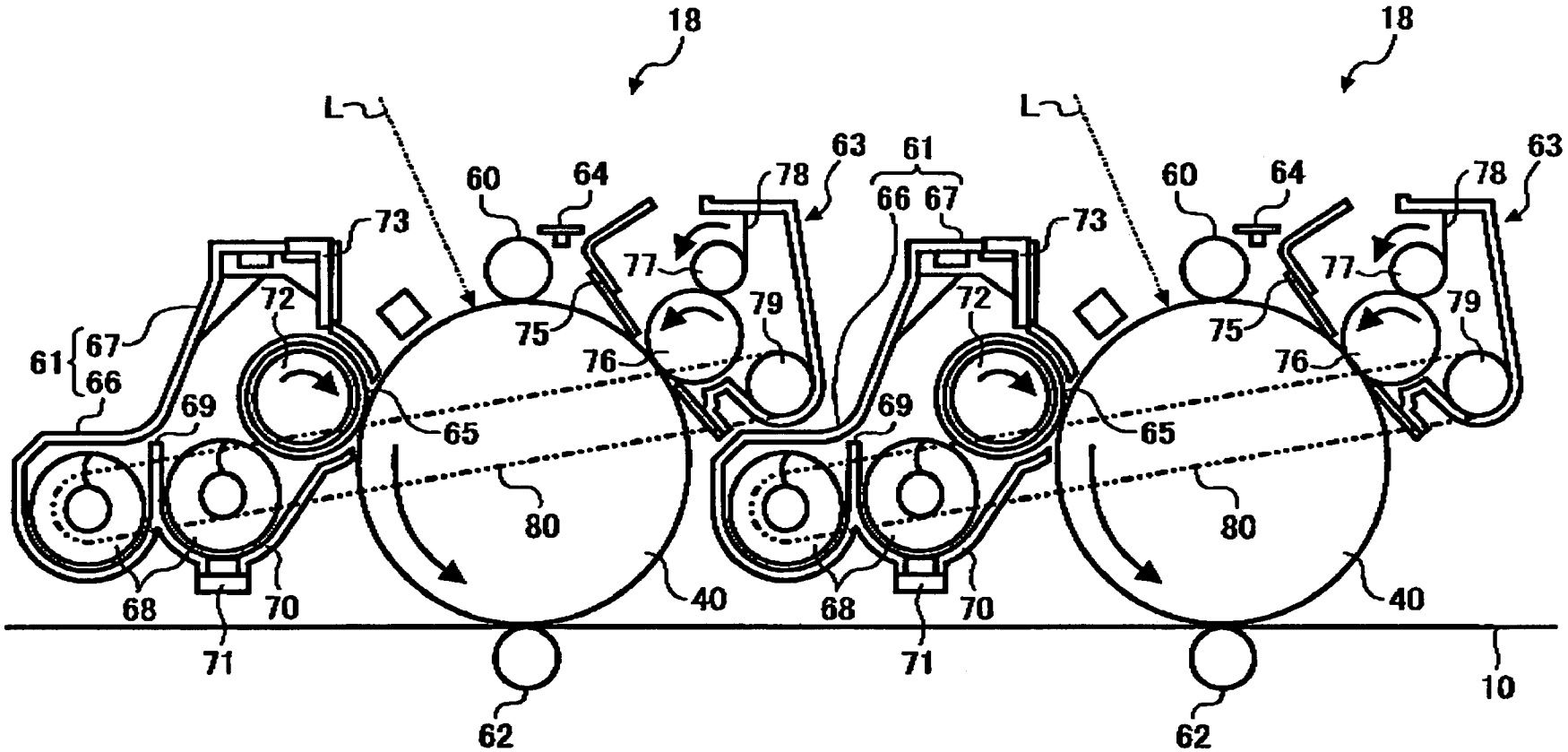
FIG. 6 is a schematic view illustrating individual image developers of the tandem-type electrophotographic image forming apparatus in FIG. 5.

In the tandem image forming apparatus 20, each of the image forming units 18 includes, as shown in FIG. 6, a charger 60, an image developer 61, a first transferer 62, a photoreceptor cleaner 63 and a discharger 64 around a drum-shaped photoreceptor 40.

Figure 7:
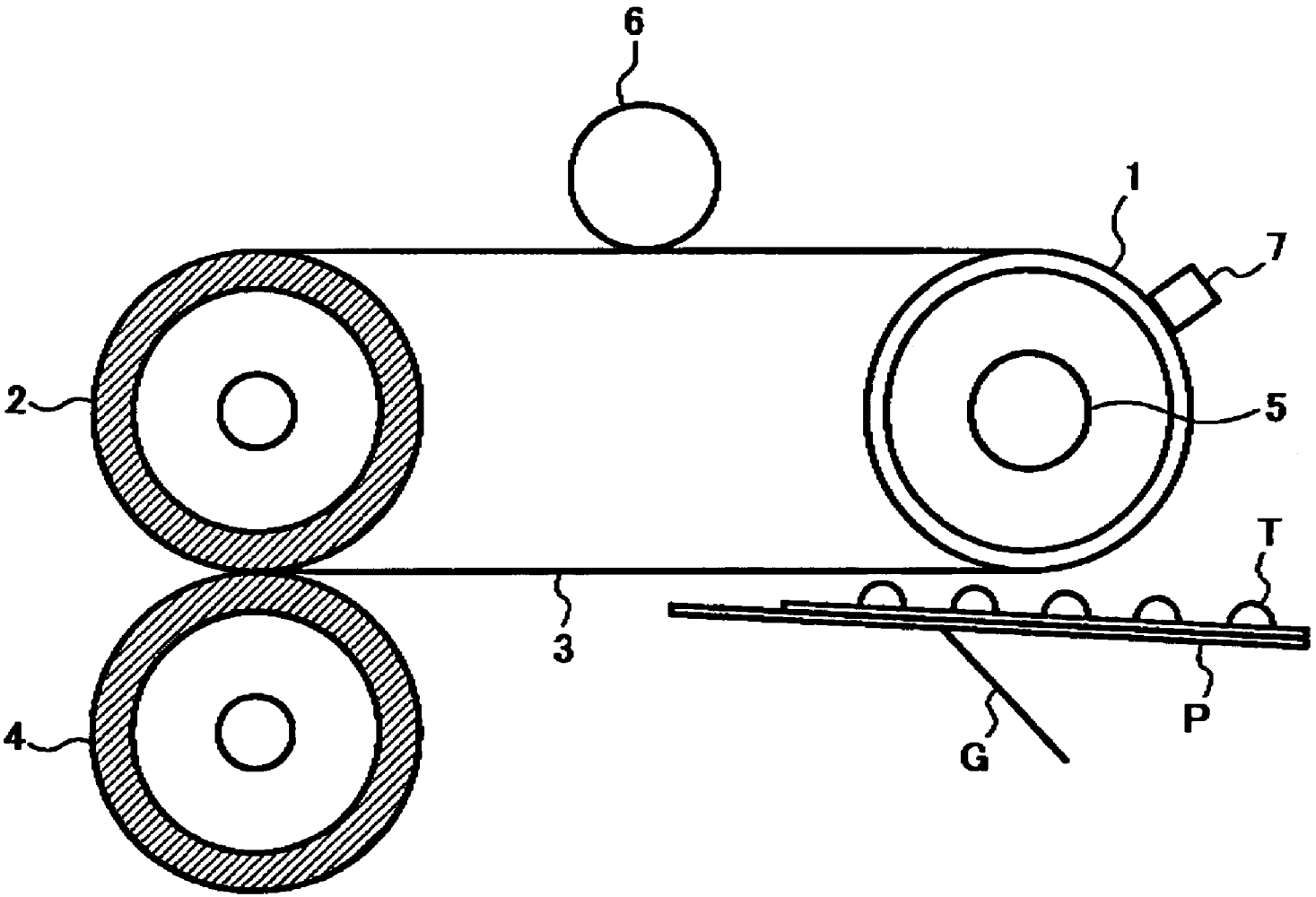
FIG. 7 is a schematic view illustrating an embodiment of a fixer of an electrophotographic image forming apparatus.

FIG. 7 is a schematic view illustrating an embodiment of a fixer of an electrophotographic image forming apparatus. In FIG. 7, numeral 2 is a fixing roller formed of a metallic core such as aluminum and iron coated with an elastic body such as a silicone rubber and numeral 1 is a heat roller formed of a metallic cylinder such as a pipe made of aluminum, iron, copper and stainless, and a heat source therein. Numeral 7 is a temperature sensor measuring a surface temperature of a fixing belt 3 contacting the heat roller 1. Between the fixing roller 2 and heat roller 1, the fixing belt 3 is suspended. The fixing belt includes a substrate formed of a material such as nickel and polyimide, having a thickness of 30 to 150μ, and a release layer formed of a material such as a silicone rubber having a thickness of from 50 to 300 μm and a fluorinated resin having a thickness of 10 to 50 μm thereon, and which has a small heat capacity.

Numeral 4 is a pressure roller formed of a metallic core coated with an elastic body, and the pressure roller 4 pressurizes the fixing roller 2 through the fixing belt to form a nip between the fixing belt 3 and the pressure roller 4. The sizes of the members are determined on required conditions thereof.

This is one of embodiments, and the fixing roller 2 or the pressure roller 4 can have a heat source inside. In the present invention, fixing belts having other structures can also be used.

The fixing belt preferably has a good heat resistance, a good releasability and a good durability, and preferably has a thickness of from 10 to 200 μm, and more preferably from 20 to 150 μm in terms of the low-temperature fixability of a toner (heat conductivity). Specific examples of the fixing belt include a single-layered film formed of a heat resistant resin such as polyimide, polyetherimide, PES (polyethersulfide) and PFA (4-fluorinated ethylene perfluoroalkylvinyl copolymer); or a multilayered film formed of a belt having a thickness of 20 μm, at least the image contact side of which is coated with a release layer having a thickness of 10 μm and including a fluorocarbon resin such as PTFE (4-fluorinated ethylene resin) and PFA and an electroconductive material, or coated with an elastic layer formed of a fluorocarbon rubber, a silicone rubber, etc.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

When evaluating images with a two-component developer, 100 parts of a ferrite carrier having an average particle diameter of 35 μm, coated with a silicone resin layer having an average thickness of 0.5 μm, and 7 parts of each color toner were uniformly mixed in a Turbula mixer to form a two-component developer as follows.

The following coating materials were dispersed by a stirrer for 10 min to prepare a coating liquid.

| | |
|---|---|
| Toluene | 450 |
| Silicone resin SR2400 having a nonvolatile matter of 50% from Dow Corning Toray Silicone Co., Ltd. | 450 |
| Amino silane SH6020 from Dow Corning Toray Silicone Co., Ltd. | 10 |
| Carbon black | 10 |

The coating liquid was coated on the following core material by a coater coating while forming a spiral flow with a rotational bottom board disc and a stirring blade in a fluidizing bed.

Mn Ferrite particle having 5,000 a weight-average particle diameter of 35 μm

The coated material was calcined in an electric oven at 250° C. for 2 hrs to prepare the above-mentioned carrier.

Example 1

683 parts of water, 11 parts of a sodium salt of an adduct of a sulfuric ester with ethyleneoxide methacrylate (ELEMINOL RS-30 from Sanyo Chemical Industries, Ltd.), 83 parts of styrene, 166 parts of methacrylate, 110 parts of butylacrylate and 1 part of persulfate ammonium were mixed in a reactor vessel including a stirrer and a thermometer, and the mixture was stirred for 30 min at 3,800 rpm to prepare a white emulsion therein. The white emulsion was heated to have a temperature of 75° C. and reacted for 4 hrs. Further, 30 parts of an aqueous solution of persulfate ammonium having a concentration of 1% were added thereto and the mixture was reacted for 6 hrs at 75° C. to prepare an aqueous dispersion a [particulate dispersion liquid 1] of a vinyl resin (a copolymer of a sodium salt of an adduct of styrene-methacrylate-butylacrylate-sulfuric ester with ethyleneoxide methacrylate). The [particulate dispersion liquid 1] was measured by LA-920 to find a volume-average particle diameter thereof was 110 nm. A part of the [particulate dispersion liquid 1] was dried to isolate a resin component therefrom. The resin component had a Tg of 58° C. and a weight-average molecular weight of 130,000.

990 parts of water, 83 parts of the [particulate dispersion liquid 1], 37 parts of an aqueous solution of sodium dodecyldiphenyletherdisulfonate having a concentration of 48.5% (ELEMINOL MON-7 from Sanyo Chemical Industries, Ltd.) and 90 parts of ethyl acetate were mixed and stirred to prepare a lacteous liquid an [aqueous phase 1].

229 parts of an adduct of bisphenol A with 2 moles of ethyleneoxide, 529 parts of an adduct of bisphenol A with 3 moles of propyleneoxide, 208 parts terephthalic acid, 46 parts of adipic acid and 2 parts of dibutyltinoxide were polycondensated in a reactor vessel including a cooling pipe, a stirrer and a nitrogen inlet pipe for 11 hrs at a normal pressure and 230° C. Further, after the mixture was depressurized by 10 to 15 mm Hg and reacted for 5 hrs, 44 parts of trimellitic acid anhydride were added thereto and the mixture was reacted for 4 hrs at a normal pressure and 180° C. to prepare a [low-molecular-weight polyester 1]. The [low-molecular-weight polyester 1] had a number-average molecular weight of 7,800, a weight-average molecular weight of 16,500, a Tg of 46° C. and an acid value of 25.

682 parts of an adduct of bisphenol A with 2 moles of ethyleneoxide, 81 parts of an adduct of bisphenol A with 2 moles of propyleneoxide, 283 parts terephthalic acid, 22 parts of trimellitic acid anhydride and 2 parts of dibutyltinoxide were mixed and reacted in a reactor vessel including a cooling pipe, a stirrer and a nitrogen inlet pipe for 8 hrs at a normal pressure and 230° C. Further, after the mixture was depressurized by 10 to 15 mm Hg and reacted for 5 hrs to prepare an [intermediate polyester 1]. The [intermediate polyester 1] had a number-average molecular weight of 3,200, a weight-average molecular weight of 10,300, a Tg of 54° C. and an acid value of 0.5 and a hydroxyl value of 52.

Next, 410 parts of the [intermediate polyester 1], 89 parts of isophoronediisocyanate and 500 parts of ethyl acetate were reacted in a reactor vessel including a cooling pipe, a stirrer and a nitrogen inlet pipe for 5 hrs at 100° C. to prepare a [prepolymer 1]. The [prepolymer 1] included a free isocyanate in an amount of 1.53% by weight.

170 parts of isophorondiamine and 75 parts of methyl ethyl ketone were reacted at 50° C. for 4 hrs in a reaction vessel including a stirrer and a thermometer to prepare a [ketimine compound 1]. The [ketimine compound 1] had an amine value of 417.

1,200 parts of water, 540 parts of carbon black Printex 35 from Degussa A.G. having a DBP oil absorption of 42 ml/100 mg and a pH of 9.5, 1,200 parts of the [low-molecular-weight polyester 1] were mixed by a Henschel mixer from Mitsui Mining Co., Ltd. After the mixture was kneaded by a two-roll mill having a surface temperature of 110° C. for 1 hr, the mixture was extended by applying pressure, cooled and pulverized by a pulverizer to prepare a [master batch 1].

378 parts of the [low-molecular-weight polyester 1], 100 parts of carnauba wax and 947 parts of ethyl acetate were mixed in a reaction vessel including a stirrer and a thermometer. The mixture was heated to have a temperature of 80° C. while stirred. After the temperature of 80° C. was maintained for 5 hrs, the mixture was cooled to have a temperature of 30° C. in an hour. Then, 500 parts of the [master batch 1] and 500 parts of ethyl acetate were added to the mixture and mixed for 1 hr to prepare a [material solution 1].

1,324 parts of the [material solution 1] were transferred into another vessel, and the carbon black and wax therein were dispersed by a beads mill (Ultra Visco Mill from IMECS CO., LTD.) for 3 passes under the following conditions:

liquid feeding speed of 1 kg/hr; peripheral disc speed of 6 m/sec; and filling zirconia beads having diameter of 0.5 mm for 80% by volume.

Next, 1,324 parts of an ethyl acetate solution of the [low-molecular-weight polyester 1] having a concentration of 65% were added to the [material solution 1] and the mixture was stirred by the beads mill for 2 passes under the same conditions to prepare a [pigment and wax dispersion liquid 1]. The [pigment and wax dispersion liquid 1] had a solid content concentration of 50% at 130° C. for 30 min.

749 parts of the [pigment and wax dispersion liquid 1], 115 parts of the [prepolymer 1] and 2.9 parts of the [ketimine compound 1] were mixed in a vessel by a TK-type homomixer from Tokushu Kika Kogyo Co., Ltd. at 5,000 rpm for 2 min. 1,200 parts of the [aqueous phase 1] were added to the mixture and mixed by the TK-type homomixer at 13,000 rpm for 25 min to prepare an [emulsified slurry 1].

The [emulsified slurry 1] was put in a vessel including a stirrer and a thermometer. After a solvent was removed from the emulsified slurry 1 at 30° C. for 8 hrs, the slurry was aged at 40° C. for 24 hrs to prepare a [dispersion slurry 1].

After the [dispersion slurry 1] was filtered under reduced pressure, 100 parts of ion-exchange water were added to the filtered cake and mixed by the TK-type homomixer at 12,000 rpm for 10 min, and the mixture was filtered.

Further, 100 parts of an aqueous solution of 10% sodium hydrate were added to the filtered cake and mixed by the TK-type homomixer at 12,000 rpm for 10 min, and the mixture was filtered under reduced pressure.

Further, 100 parts of 10% hydrochloric acid were added to the filtered cake and mixed by the TK-type homomixer at 12,000 rpm for 10 min, and the mixture was filtered.

Further, 300 parts of ion-exchange water were added to the filtered cake and mixed by the TK-type homomixer at 12,000 rpm for 10 min, and the mixture was filtered. This operation was repeated again to prepare a [filtered cake 1].

The [filtered cake 1] was dried by an air drier at 45° C. for 48 hrs and sieved by a mesh having an opening of 75 μm to prepare a [toner particle 1]. Then, 1 part of hydrophobized silica was mixed with 100 parts of the [toner particle 1] by a Henschel mixer to prepare a toner. Properties and evaluation results of the toner are shown in Tables 1 and 2 respectively.

Example 2

The procedure for preparation of the toner in Example 1 was repeated to prepare a toner except for the following procedure. Properties and evaluation results of the toner are shown in Tables 1 and 2 respectively.

378 parts of the [low-molecular-weight polyester 1], 100 parts of carnauba/rice wax (a weight ratio 7:3) and 947 parts of ethyl acetate were mixed in a reaction vessel including a stirrer and a thermometer, and the mixture was heated to have a temperature of 80° C. while stirred. After the temperature of 80° C. was maintained for 3 hrs, the mixture was cooled to have a temperature of 30° C. in an hour, and then 500 parts of the master batch 1 and 500 parts of ethyl acetate were added to the mixture and mixed for 1 hr to prepare a [material solution 2].

1,324 parts of the [material solution 2] were transferred into another vessel, and the carbon black and wax therein were dispersed by a beads mill (Ultra Visco Mill from IMECS CO., LTD.) for 7 passes under the following conditions:

liquid feeding speed of 1 kg/hr; peripheral disc speed of 6 m/sec; and filling zirconia beads having diameter of 0.5 mm for 80% by volume.

Next, 1,324 parts of an ethyl acetate solution of the [low-molecular-weight polyester 1] having a concentration of 65% were added to the [material solution 2] and the mixture was stirred by the beads mill for 4 passes under the same conditions to prepare a [pigment and wax dispersion liquid 2]. The [pigment and wax dispersion liquid 2] had a solid content concentration of 50% at 130° C. for 30 min.

Example 3

The procedure for preparation of the toner in Example 1 was repeated to prepare a toner except for the following procedure. Properties and evaluation results of the toner are shown in Tables 1 and 2 respectively.

749 parts of the [pigment and wax dispersion liquid 1], 115 parts of the [prepolymer 1] and 2.9 parts of the [ketimine compound 1] were mixed in a vessel by a TK-type homomixer from Tokushu Kika Kogyo Co., Ltd. at 5,000 rpm for 3 min. 1,200 parts of the [aqueous phase 1] were added to the mixture and mixed by the TK-type homomixer at 13,000 rpm for 10 min to prepare an [emulsified slurry 2].

The [emulsified slurry 2] was put in a vessel including a stirrer and a thermometer. After a solvent was removed from the emulsified slurry 1 at 30° C. for 6 hrs, the slurry was aged at 45° C. for 10 hrs to prepare a [dispersion slurry 2].

Example 4

The procedure for preparation of the toner in Example 1 was repeated to prepare a toner except for the following procedure. Properties and evaluation results of the toner are shown in Tables 1 and 2 respectively.

749 parts of the [pigment and wax dispersion liquid 1], 115 parts of the [prepolymer 1] and 2.9 parts of the [ketimine compound 1] were mixed in a vessel by a TK-type homomixer from Tokushu Kika Kogyo Co., Ltd. at 5,000 rpm for 2 min. 1,200 parts of the [aqueous phase 1] were added to the mixture and mixed by the TK-type homomixer at 13,000 rpm for 40 min to prepare an [emulsified slurry 3].

The [emulsified slurry 3] was put in a vessel including a stirrer and a thermometer. After a solvent was removed from the emulsified slurry 1 at 30° C. for 7 hrs, the slurry was aged at 45° C. for 7 hrs to prepare a [dispersion slurry 3].

Example 5

The procedure for preparation of the toner in Example 1 was repeated to prepare a toner except for the following procedure. Properties and evaluation results of the toner are shown in Tables 1 and 2 respectively.

378 parts of the [low-molecular-weight polyester 1], 130 parts of carnauba/rice wax (a weight ratio 7:3) and 947 parts of ethyl acetate were mixed in a reaction vessel including a stirrer and a thermometer, and the mixture was heated to have a temperature of 80° C. while stirred. After the temperature of 80° C. was maintained for 4 hrs, the mixture was cooled to have a temperature of 30° C. in an hour, and then 500 parts of the [master batch 1] and 500 parts of ethyl acetate were added to the mixture and mixed for 2 hrs to prepare a [material solution 3].

1,324 parts of the [material solution 3] were transferred into another vessel, and the carbon black and wax therein were dispersed by a beads mill (Ultra Visco Mill from IMECS CO., LTD.) for 7 passes under the following conditions:

liquid feeding speed of 1 kg/hr; peripheral disc speed of 6 m/sec; and filling zirconia beads having diameter of 0.5 mm for 80% by volume.

Next, 1,324 parts of an ethyl acetate solution of the [low-molecular-weight polyester 1] having a concentration of 65% were added to the [material solution 3] and the mixture was stirred by the beads mill for 4 passes under the same conditions to prepare a [pigment and wax dispersion liquid 3]. The [pigment and wax dispersion liquid 3] had a solid content concentration of 50% at 130° C. for 30 min.

Example 6

The procedure for preparation of the toner in Example 1 was repeated to prepare a toner except for the following procedure. Properties and evaluation results of the toner are shown in Tables 1 and 2 respectively.

378 parts of the [low-molecular-weight polyester 1], 400 parts of carnauba wax and 947 parts of ethyl acetate were mixed in a reaction vessel including a stirrer and a thermometer, and the mixture was heated to have a temperature of 80° C. while stirred. After the temperature of 80° C. was maintained for 4 hrs, the mixture was cooled to have a temperature of 30° C. in an hour, and then 500 parts of the [master batch 1] and 500 parts of ethyl acetate were added to the mixture and mixed for 2 hrs to prepare a [material solution 4].

1,324 parts of the [material solution 4] were transferred into another vessel, and the carbon black and wax therein were dispersed by a beads mill (Ultra Visco Mill from IMECS CO., LTD.) for 7 passes under the following conditions:

liquid feeding speed of 1 kg/hr; peripheral disc speed of 6 m/sec; and filling zirconia beads having diameter of 0.5 mm for 80% by volume.

Next, 1,324 parts of an ethyl acetate solution of the [low-molecular-weight polyester 1] having a concentration of 65% were added to the [material solution 4] and the mixture was stirred by the beads mill for 4 passes under the same conditions to prepare a [pigment and wax dispersion liquid 4]. The [pigment and wax dispersion liquid 3] had a solid content concentration of 50% at 130° C. for 30 min.

Example 7

The procedure for preparation of the toner in Example 1 was repeated to prepare a toner except for the following procedure. Properties and evaluation results of the toner are shown in Tables 1 and 2 respectively.

749 parts of the [pigment and wax dispersion liquid 1], 115 parts of the [prepolymer 1] and 2.9 parts of the [ketimine compound 1] were mixed in a vessel by a TK-type homomixer from Tokushu Kika Kogyo Co., Ltd. at 5,000 rpm for 2 min. 1,200 parts of the [aqueous phase 1] were added to the mixture and mixed by the TK-type homomixer at 13,000 rpm for 90 min to prepare an [emulsified slurry 4].

The [emulsified slurry 4] was put in a vessel including a stirrer and a thermometer. After a solvent was removed from the emulsified slurry 1 at 30° C. for 8 hrs, the slurry was aged at 45° C. for 10 hrs to prepare a [dispersion slurry 4].

Example 8

The procedure for preparation of the toner in Example 1 was repeated to prepare a toner except for the following procedure. Properties and evaluation results of the toner are shown in Tables 1 and 2 respectively.

749 parts of the [pigment and wax dispersion liquid 1], 115 parts of the [prepolymer 1], 2.9 parts of the [ketimine compound 1] and 1,200 parts of the [aqueous phase 1] were mixed by the TK-type homomixer at 13,000 rpm for 1 hr to prepare an [emulsified slurry 5].

The [emulsified slurry 5] was put in a vessel including a stirrer and a thermometer. After a solvent was removed from the emulsified slurry 1 at 30° C. for 8 hrs, the slurry was aged at 45° C. for 10 hrs to prepare a [dispersion slurry 5].

Example 9

The procedure for preparation of the toner in Example 1 was repeated to prepare a toner except for the following procedure. Properties and evaluation results of the toner are shown in Tables 1 and 2 respectively.

229 parts of an adduct of bisphenol A with 2 moles of ethyleneoxide, 529 parts of an adduct of bisphenol A with 3 moles of propyleneoxide, 208 parts terephthalic acid, 46 parts of adipic acid and 2 parts of dibutyltinoxide were polycondensated in a reactor vessel including a cooling pipe, a stirrer and a nitrogen inlet pipe for 11 hrs at a normal pressure and 230° C. Further, after the mixture was depressurized by 10 to 15 mm Hg and reacted for 5 hrs, 44 parts of trimellitic acid anhydride were added thereto and the mixture was reacted for 3 hrs at a normal pressure and 175° C. to prepare a [low-molecular-weight polyester 2]. The [low-molecular-weight polyester 2] had a number-average molecular weight of 6,200, a weight-average molecular weight of 10,300, a Tg of 46° C. and an acid value of 25.

Comparative Example 1

The procedure for preparation of the toner in Example 1 was repeated to prepare a toner except for the following procedure. Properties and evaluation results of the toner are shown in Tables 1 and 2 respectively.

229 parts of an adduct of bisphenol A with 2 moles of ethyleneoxide, 529 parts of an adduct of bisphenol A with 3 moles of propyleneoxide, 208 parts terephthalic acid, 46 parts of adipic acid and 2 parts of dibutyltinoxide were polycondensated in a reactor vessel including a cooling pipe, a stirrer and a nitrogen inlet pipe for 7 hrs at a normal pressure and 230° C. Further, after the mixture was depressurized by 10 to 15 mm Hg and reacted for 5 hrs, 44 parts of trimellitic acid anhydride were added thereto and the mixture was reacted for 3 hrs at a normal pressure and 180° C. to prepare a [low-molecular-weight polyester 3]. The [low-molecular-weight polyester 3] had a number-average molecular weight of 2,300, a weight-average molecular weight of 6,700, a Tg of 43° C. and an acid value of 25.

378 parts of the [low-molecular-weight polyester 3], 100 parts of carnauba wax and 947 parts of ethyl acetate were mixed in a reaction vessel including a stirrer and a thermometer, and the mixture was heated to have a temperature of 80° C. while stirred. After the temperature of 80° C. was maintained for 5 hrs, the mixture was cooled to have a temperature of 30° C. in an hour, and then 500 parts of the [master batch 1] and 500 parts of ethyl acetate were added to the mixture and mixed for 1 hr to prepare a [material solution 5].

1,324 parts of the [material solution 5] were transferred into another vessel, and the carbon black and wax therein were dispersed by a beads mill (Ultra Visco Mill from IMECS CO., LTD.) for 3 passes under the following conditions:

liquid feeding speed of 1 kg/hr; peripheral disc speed of 6 m/sec; and filling zirconia beads having diameter of 0.5 mm for 80% by volume.

Next, 1,324 parts of an ethyl acetate solution of the [low-molecular-weight polyester 2] having a concentration of 65% were added to the [material solution 5] and the mixture was stirred by the beads mill for 2 passes under the same conditions to prepare a [pigment and wax dispersion liquid 5]. The [pigment and wax dispersion liquid 5] had a solid content concentration of 50% at 130° C. for 30 min.

749 parts of the [pigment and wax dispersion liquid 5], 115 parts of the [prepolymer 1] and 2.9 parts of the [ketimine compound 1] were mixed in a vessel by a TK-type homomixer from Tokushu Kika Kogyo Co., Ltd. at 5,000 rpm for 2 min. 1,200 parts of the [aqueous phase 1] were added to the mixture and left for 1 hr to prepare an [emulsified slurry 6].

The [emulsified slurry 6] was put in a vessel including a stirrer and a thermometer, and a solvent was removed from the emulsified slurry 1 at 30° C. for 8 hrs to prepare a [dispersion slurry 6]. Then, the slurry was not aged.

Comparative Example 2

The following materials were mixed, dissolved, dispersed and emulsified in a flask including 550 g of ion-exchange water including 6 g of a dissolved nonionic surfactant Nonipol 400 from Sanyo Chemical Industries, Ltd. and 10 g of a dissolved anionic surfactant Neogen SC from Dai-ichi Kogyo Seiyaku Co., Ltd.

| | |
|---|---|
| Styrene | 370 g |
| N-butylacrylate | 30 g |
| Acrylic acid | 8 g |
| Dodecanethiol | 24 g |
| Carbon tetrabromide | 4 g |

After 50 g of ion-exchange water including 4 g of dissolved ammonium per sulfate were put in the emulsified mixture to perform a nitrogen substitution while slowly mixed for 10 min, the mixture in the flask was heated to have a temperature of 70° C. with an oil bath while stirred and the emulsion polymerization was continued for 5 hrs. Thus, a dispersion liquid (1) including a dispersed resin particle having an average particle diameter of 155 nm, a Tg of 59° C. and a weight-average molecular weight of 12,000 was prepared.

The following materials were mixed, dissolved, dispersed and emulsified in a flask including 550 g of ion-exchange water including 6 g of a dissolved nonionic surfactant Nonipol 400 from Sanyo Chemical Industries, Ltd. and 12 g of a dissolved anionic surfactant Neogen SC from Dai-ichi Kogyo Seiyaku Co., Ltd.

| | |
|---|---|
| Styrene | 280 g |
| N-butylacrylate | 120 g |
| Acrylic acid | 8 g |

After 50 g of ion-exchange water including 3 g of dissolved ammonium persulfate were put in the emulsified mixture to perform a nitrogen substitution while slowly mixed for 10 min, the mixture in the flask was heated to have a temperature of 70° C. with an oil bath while stirred and the emulsion polymerization was continued for 5 hrs. Thus, a dispersion liquid (2) including a dispersed resin particle having an average particle diameter of 105 nm, a Tg of 53° C. and a weight-average molecular weight of 550,000 was prepared.

The following materials were mixed, dissolved and dispersed by a homogenizer T50 from IKA-WERKE GMBH & CO., KG. for 10 min to prepare a colorant dispersion liquid (1) including a colorant (carbon black) having an average particle diameter of 250 nm.

| | |
|---|---|
| Carbon black (Mogal L from Cabot Corp.) | 50 g |
| Nonionic surfactant (Nonipol 400 from Sanyo Chemical Industries, Ltd. | 5 g |
| Ion-exchange water | 200 g |

After the following materials were heated at 95° C. and dispersed by a homogenizer T50 from IKA-WERKE GMBH & CO., KG., the mixture was dispersed by a pressure discharging homogenizer to prepare a release agent dispersion liquid (1) including a release agent having an average particle diameter of 550 nm.

| | |
|---|---|
| Paraffin wax (HNP0190 having a melting point of 85° C. from Nippon Seiro Co., Ltd.) | 50 g |
| Cationic surfactant (Sanisol B50 from Kao Corp.) | 5 g |
| Ion-exchange water | 200 g |

After the following materials were mixed and dispersed by homogenizer T50 from IKA-WERKE GMBH & CO., KG. in a round stainless flask, the mixture was heated to have a temperature of 48° C. while stirred in a heating oil bath.

| | |
|---|---|
| Dispersion liquid (1) | 120 g |
| Dispersion liquid (2) | 80 g |
| Colorant dispersion liquid (1) | 30 g |
| Release agent dispersion liquid (1) | 40 g |
| Cationic surfactant (Sanisol B50 from Kao Corp.) | 1.5 g |

After the mixture was maintained to have the temperature of 48° C. for 30 min, the mixture was observed by an optical microscope to find that agglomerated particles having an average particle diameter of about 5 μm and a volume of 95 $cm^3$ were formed.

Further, 60 g of the dispersion liquid (1) were gradually added into the mixture. The resin particles included in the dispersion liquid (1) had a volume of 25 $cm^3$. Then, the mixture was left for 1 hr after the temperature of the heating oil bath was raised to 50° C.

Then, after 3 g of the anionic surfactant Neogen SC from Dai-ichi Kogyo Seiyaku Co. were added into the mixture, the mixture was closed in the stainless flask and heated to have a temperature of 105° C. while stirred with a magnetic seal for 3 hrs. Then, after the mixture was cooled, a reaction product was filtered, fully washed with ion-exchange water and dried to prepare a toner particle. Then, each 1 part of hydrophobic silica and hydrophobic titanium oxide were mixed with 100 parts of the toner particle by a Henschel mixer to prepare a toner. Properties and evaluation results of the toner are shown in Tables 1 and 2 respectively.

Comparative Example 3

In a reaction container with a condenser, a stirrer and a nitrogen introducing tube, 724 parts of an adduct of bisphenol A with 2 moles of ethyleneoxide, 276 parts of isophthalic acid and 2 parts of dibutyltinoxide were reacted for 8 hrs at 230° C. under a normal pressure. Then, after the reaction was further performed for 5 hrs under a reduced pressure of from 10 to 15 mmHg, the reaction product was cooled to have a temperature of 160° C. and 32 parts of phthalic anhydride were added thereto to further perform a reaction for 2 hrs. Then, the reaction production was cooled to have a temperature of 80° C. and mixed with 188 parts of isophorondiisocyanate in ethyl acetate and reacted for 2 hrs to prepare a prepolymer including an isocyanate group (1).

Next, 267 parts of the prepolymer (1) and 14 parts of isophoronediamine were reacted for 2 hrs at 50° C. to prepare a urea-modified polyester (1) having a weight-average molecular weight of 64,000. Similarly, 724 parts of an adduct of bisphenol A with 2 moles of ethyleneoxide, 138 parts of terephthalic acid and 138 parts of isophthalic acid were polycondensated for 6 hrs at 230° C. under a normal pressure. Then, after the reaction was further performed for 5 hrs under a reduced pressure of from 10 to 15 mmHg to prepare an unmodified polyester (a) having a peak molecular weight of 2,300, a hydroxyl value of 55 and an acid value of 1. 200 parts of the urea-modified polyester (1) and 800 parts of the unmodified polyester (a) were dissolved and mixed in 1,000 parts of a mixed solvent including ethyl acetate/MEK (1/1) to prepare an acetate/MEK liquid solution including a toner binder (1).

In a reaction container with a condenser, a stirrer and a thermometer, 1,000 parts of the acetate/MEK liquid solution including a toner binder (1) were added to 942 parts of water and 58 parts of a slurry including hydroxy apatite by 10% (Supertite 10 from Nippon Chemical Industrial Co., Ltd.) while stirred, and dispersed. Then, the dispersed materials were heated to have a temperature of 98° C. and an organic solvent was removed therefrom, and cooled, filtered, washed and dried to prepare a toner binder (1). The toner binder (1) had a Tg of 52° C., Tρ of 123° C. and TG' of 132° C.

After 100 parts of the toner binder (1), 7 parts of glycerinetribehenate and 4 parts of cyanine blue KRO from SANYO COLOR WORKS, Ltd. were premixed by a Henschel mixer FM10B from Mitsui Mining Co., Ltd., the mixture was kneaded by a biaxial kneader PCM-30 from Ikegai Corp. Then, after the mixture was pulverized by a ultrasonic jet pulverizer Labojet from Nippon Pneumatic Mfg. Co., Ltd., the mixture was classified by a stream classifier MDS-I from Nippon Pneumatic Mfg. Co., Ltd. to prepare a toner particle. Then, each 1 part of hydrophobic silica and hydrophobic titanium oxide were mixed with 100 parts of the toner particle by a Henschel mixer to prepare a toner. Properties and evaluation results of the toner are shown in Tables 1 and 2 respectively.

Comparative Example 4

In a reaction container with a condenser, a stirrer and a nitrogen introducing tube, 724 parts of an adduct of bisphenol A with 2 moles of ethyleneoxide, 276 parts of isophthalic acid and 2 parts of dibutyltinoxide were reacted for 8 hrs at 230° C. under a normal pressure. Then, after the reaction was further performed for 5 hrs under a reduced pressure of from 10 to 15 mmHg, the reaction product was cooled to have a temperature of 160° C. and 74 parts of phthalic anhydride were added thereto to further perform a reaction for 2 hrs. Then, the reaction production was cooled to have a temperature of 80° C. and mixed with 174 parts of ethyleneglycoldiglycidylether in toluene and reacted for 2 hrs to prepare a prepolymer including an epoxy group (1) and having a weight-average molecular weight of 13,000.

30 parts of isophorondiamine and 70 parts of MEK were reacted at 50° C. for 5 hrs in a reaction vessel including a stirrer and a thermometer to prepare a ketimine compound (2).

Similarly, 654 parts of an adduct of bisphenol A with 2 moles of ethyleneoxide and 516 parts of dimethylterephthalate ester were polycondensated for 6 hrs at 230° C. The reaction was further performed for 5 hrs under a reduced pressure of from 10 to 15 mmHg while dehydrating the reaction product to prepare a dead polymer (1) having a peak molecular weight of 2,400 and a hydroxyl value of 2.

15.4 parts of the prepolymer (1), 64 parts of the dead polymer (1) and 78.6 parts of ethyl acetate were stirred and dissolved in a beaker. Next, 20 parts of pentaerythritoltetrabehenate and 4 parts of cyanine blue KRO from SANYO COLOR WORKS, Ltd. were uniformly dissolved and dispersed in the mixture by a TK-type homomixer at 60° C. and 12,000 rpm. Then, 2.7 parts of the ketimine compound 2 was added to and dissolved in the mixture to prepare a toner constituent solution (1). 706 parts of ion-exchange water, 294 parts of a slurry including hydroxy apatite by 10% (Supertite 10 from Nippon Chemical Industrial Co., Ltd.) 0.2 parts of sodium dodecylbenzenesulfonate were uniformly dissolved in a beaker. The mixture was heated to have a temperature of 60° C. and the toner constituent solution (1) was added thereto while stirred by a TK-type homomixer at 12,000 rpm for 10 min. The mixture was then transferred into a flask having a stirrer and a thermometer and heated to have a temperature of 98° C., and a solvent was removed from the mixture. After the mixture was filtered, washed and dried, the mixture was classified by a wind classifier to prepare a toner particle. Then, each 1 part of hydrophobic silica and hydrophobic titanium oxide were mixed with 100 parts of the toner particle by a Henschel mixer to prepare a toner. The toner binder component had a weight-average molecular weight of 14,000, a number-average molecular weight of 2,000 and a Tg of 52° C. Properties and evaluation results of the toner are shown in Tables 1 and 2 respectively.

Comparative Example 5

The following materials were stirred in a flask with a stirrer, a condenser, a thermometer and a nitrogen introducing tube.

| | |
|---|---|
| Methanol | 300 g |
| Toluene | 100 g |
| Styrene | 570 g |
| 2-acrylamide-2-methylpropane sulfonic acid | 30 g |
| Lauroyl peroxide | 12 g |

The mixture was polymerized for 10 hrs at 65° C. while nitrogen was introduced therein. After the reaction product was dried under a reduced pressure, the reaction product was pulverized by a jet mill to prepare an A polymer having a weight-average molecular weight of 3,000.

The following materials were uniformly dissolved or dispersed at 65° C. to prepare a monomer composition.

| | |
|---|---|
| Styrene | 183 |
| 2-ethylhexylacrylate | 17 |
| A polymer | 0.1 |
| C.I. Pigment Yellow 17 | 7 |
| Paraffin wax<br>having a melting point of 155° F. | 32 |
| Initiator V-601<br>from Wako Pure Chemical Industries, Ltd. | 10 |

On the other hand, 0.3 g of a silane coupling agent KBE903 from Shin-Etsu Chemical Co., Ltd. were uniformly dispersed in 1,200 ml of ion-exchange water, and further 6 g of colloidal silica Aerosil #200 from Nippon Aerosil Co., Ltd. were uniformly dispersed therein. The dispersion liquid was blended with hydrochloric acid to have a pH of 6 to prepare a dispersion medium.

The monomer composition was put in the dispersion medium, and the monomer composition was granulated by a TK-type homomixer at 6,500 rpm and 70° C. in a nitrogen environment for 60 min. Then, the monomer composition was polymerized at 75° C. for 8 hrs while stirred with a paddle stirring blade.

After the polymerization was completed, the reaction product was cooled and 42 g of an aqueous solution including sodium hydrate by 20% by weight were added thereto, and left for 1 night. Then, the reaction product was filtered, washed and dried to prepare a polymerized toner. Properties and evaluation results of the toner are shown in Tables 1 and 2 respectively.

Comparative Example 6

The procedure for preparation of the toner in Example 1 was repeated to prepare a toner except for the following procedure. Properties and evaluation results of the toner are shown in Tables 1 and 2 respectively.

229 parts of an adduct of bisphenol A with 2 moles of ethyleneoxide, 529 parts of an adduct of bisphenol A with 3 moles of propyleneoxide, 208 parts terephthalic acid, 46 parts of adipic acid and 2 parts of dibutyltinoxide were polycondensated in a reactor vessel including a cooling pipe, a stirrer and a nitrogen inlet pipe for 7 hrs at a normal pressure and 230° C. Further, after the mixture was depressurized by 10 to 15 mm Hg and reacted for 5 hrs, 44 parts of trimellitic acid anhydride were added thereto and the mixture was reacted for 3 hrs at a normal pressure and 180° C. to prepare a [low-molecular-weight polyester 4]. The [low-molecular-weight polyester 4] had a number-average molecular weight of 2,300, a weight-average molecular weight of 6,700, a Tg of 43° C. and an acid value of 25.

Comparative Example 7

The procedure for preparation of the toner in Example 1 was repeated to prepare a toner except for the following procedure. Properties and evaluation results of the toner are shown in Tables 1 and 2 respectively.

243 parts of an adduct of bisphenol A with 2 moles of ethyleneoxide, 543 parts of an adduct of bisphenol A with 3 moles of propyleneoxide, 172 parts terephthalic acid, 51 parts of adipic acid and 2 parts of dibutyltinoxide were polycondensated in a reactor vessel including a cooling pipe, a stirrer and a nitrogen inlet pipe for 10 hrs at a normal pressure and 230° C. Further, after the mixture was depressurized by 10 to 15 mm Hg and reacted for 7 hrs, 44 parts of trimellitic acid anhydride were added thereto and the mixture was reacted for 4 hrs at a normal pressure and 180° C. to prepare a [low-molecular-weight polyester 5]. The [low-molecular-weight polyester 5] had a number-average molecular weight of 13,000, a weight-average molecular weight of 34,000, a Tg of 49° C. and an acid value of 25.

The following items are evaluated for each of the toners prepared in Examples 1 to 9 and Comparative Example 1 to 7.

1) Fixability (Hot Offset Resistance and Low-Temperature Fixability)

Imagio Neo 450 was modified to have a fixing belt, and a solid image was produced on an ordinary transfer paper and a thick transfer paper, i.e., TYPE6200 from Ricoh Company, Ltd. and Copy Paper <135> from NBS RICOH Co., Ltd. such that a toner adhered thereto in an amount of 1.0±0.1 mg/cm$^2$. A temperature of the fixing belt was changed to perform a fixing test and a maximum temperature at which the hot offset does not occur on the ordinary transfer paper was determined as a maximum fixable temperature. A temperature at which the image density of an image produced on the thick paper had a residual ratio not less than 70% was determined as a minimum fixable temperature. It is desirable that the maximum fixable temperature is not less than 200° C., and the minimum fixable temperature is not greater than 140° C.

2) Glossiness

Imagio Neo 450 was modified to have a fixing belt, and a solid image was produced on an ordinary transfer paper TYPE 6200 from Ricoh Company, Ltd. such that a toner adhered thereto in an amount of 0.4±0.05 mg/cm$^2$. The glossiness thereof was measured by a glossmeter VG-1D from Nippon Denshoku Industries Co., Ltd.

◎: 6 or more
○: from 4 to less than 6
Δ: from 3 to less than 4
X: less than 3

3) Apparatus and Image Contamination

IPSiO Color 8100 from Ricoh Company, Ltd. was modified to have an oilless fixer, and 100,000 images of a chart having an image area ratio of 5% were produced thereby to evaluate contaminations of the fixer and images.

◎: The apparatus was scarcely contaminated
○: The apparatus was contaminated but the images were not contaminated
Δ: Images were slightly contaminated
X: Images were seriously contaminated 4) Friction Resistance IPSiO Color 8100 from Ricoh Company, Ltd. was modified to have an oilless fixer, and a solid image was produced on an ordinary transfer paper TYPE 6200 from Ricoh Company, Ltd. such that a toner adhered thereto at 140° C. in an amount of 0.8±0.05 mg/cm$^2$. The image was scraped with a cotton for 100 times to visually observe peeling status thereof.

◎: No peeling
○: Almost no peeling but the cotton was slightly colored
Δ: Slightly peeled
X: Seriously peeled 5) Transferability After an image of a chart having an image area of 20% was transferred onto a paper from a photoreceptor, a residual toner on a photoreceptor just before cleaned was adhered on a Scotch Tape from Sumitomo 3M Ltd. and transferred onto a white paper. Density of the white paper was measured by Macbeth reflection densitometer RD514. When a density difference between the white paper the residual toner was transferred to and a blank white paper was less than 0.005, the cleanability was determined as ◎. From 0.005 to 0.010 was ○, from 0.011 to 0.02 was Δ and greater than 0.02 was X.

6) Charged Stability

Before and after 100,000 copies of a chart having an image area of 5% were continuously produced by IPSio Color 8100 from Ricoh Company, Ltd. modified to have an oilless fixer, a charged amount of 1 g of the developer was measured by a blow-off method. A variation of the charge amount of not greater than 5 μc/g was ○, not greater than 10 μc/g was Δ and greater than 10 μc/g was X.

7) Image Granularity and Sharpness

A mono-color image produced by IPSio Color 8100 from Ricoh Company, Ltd. modified to have an oilless fixer was visually observed to evaluate the image granularity and sharpness. ◎ was as good as an offset printing, ○ was slightly worse than the offset printing, Δ was considerably worse than the offset printing and X was very poor.

8) Foggy Image

After 100,000 copies of a chart having an image area of 5% were continuously produced by IPSio Color 8100 from Ricoh Company, Ltd. modified to have an oilless fixer at 10° C. and a humidity of 15%, the background of the last image was visually observed to evaluate the toner contamination thereon. ◎ means that no toner contamination was observed, ○ means a slight contamination without problems, Δ means a contamination was observed and X means an unacceptable contamination with serious problems.

9) Toner Scattering

After 100,000 copies of a chart having an image area of 5% were continuously produced by IPSio Color 8100 from Ricoh Company, Ltd. modified to have an oilless fixer at 40° C. and a humidity of 90%, the toner contamination in IPSio Color 8100 was visually observed. ◎ means that no toner contamination was observed, ○ means a slight contamination without problems, Δ means a contamination was observed and X means an unacceptable contamination with serious problems.

10) Environmental (Blocking) Resistance 10 g of the toner was put in a glass container having a capacity of 20 ml and the glass container was tapped for 100 times. Then, after the glass container was left in a constant temperature bath having a temperature of 55° C. and a humidity of 80% for 24 hrs, a penetration of the toner was measured by a penetrometer. A penetration thereof left in an environment of low temperature and low humidity was also measured. A smaller penetration in either of the high temperature and humidity environment and the low temperature and humidity environment was used to evaluate. The larger the better. ◎ was not less than 20 mm, ○ was not less than 15 mm and less than 20 mm, Δ was not less than 10 mm and less than 15 mm and X was less than 10 mm.

TABLE 1

| | Mn | Mw/Mn | * (%) | Average circularity | SF-1 | SF-2 | Dv | Dn | Dv/Dn |
|---|---|---|---|---|---|---|---|---|---|
| Ex. 1 | 4,100 | 6.1 | 3.7 | 0.97 | 131 | 122 | 5.4 | 4.9 | 1.10 |
| Ex. 2 | 6,100 | 7.8 | 1.7 | 0.96 | 129 | 131 | 5.2 | 4.6 | 1.13 |
| Ex. 3 | 3,800 | 2.1 | 0.4 | 0.97 | 138 | 128 | 4.9 | 4.5 | 1.09 |
| Ex. 4 | 6,800 | 9.0 | 19.0 | 0.98 | 133 | 139 | 5.7 | 5.0 | 1.14 |
| Ex. 5 | 5,900 | 8.0 | 17.0 | 0.97 | 128 | 140 | 5.5 | 4.5 | 1.22 |
| Ex. 6 | 4,300 | 4.0 | 4.0 | 0.92 | 151 | 152 | 6.4 | 5.4 | 1.19 |
| Ex. 7 | 4,900 | 6.3 | 3.9 | 0.93 | 138 | 139 | 8.2 | 6.8 | 1.21 |
| Ex. 8 | 2,400 | 5.1 | 5.1 | 0.94 | 128 | 134 | 6.9 | 5.4 | 1.28 |
| Ex. 9 | 3,900 | 4.8 | 2.8 | 0.97 | 130 | 125 | 5.3 | 4.8 | 1.10 |
| Com. Ex. 1 | 1,900 | 4.0 | 0.3 | 0.97 | 119 | 120 | 5.0 | 4.4 | 1.14 |
| Com. Ex. 2 | | Insoluble | | 0.94 | 141 | 155 | 6.2 | 5.6 | 1.11 |
| Com. Ex. 3 | 4,300 | 1.4 | 0.4 | 0.88 | 160 | 155 | 7.0 | 5.4 | 1.30 |
| Com. Ex. 4 | 8,100 | 11.0 | 19.0 | 0.94 | 138 | 138 | 3.3 | 2.8 | 1.18 |
| Com. Ex. 5 | | Insoluble | | 0.96 | 125 | 123 | 7.1 | 5.8 | 1.22 |
| Com. Ex. 6 | 1,800 | 2.8 | 0.2 | 0.97 | 123 | 120 | 5.3 | 4.7 | 1.13 |
| Com. Ex. 7 | 7,600 | 7.5 | 21.0 | 0.96 | 142 | 136 | 6.1 | 5.2 | 1.17 |

* A content of HFIP-soluble component of the toner, having a number-average molecular weight not less than 100,000

TABLE 2

| | 1) Min. (° C.) | 1) Max. (° C.) | 2) | 3) | 4) | 5) | 6) | 7) | 8) | 9) | 10) |
|---|---|---|---|---|---|---|---|---|---|---|---|
| Ex. 1 | 140 | 210 or more | ◎ | ○ | ○ | ○ | ○ | ○ | ○ | ○ | ○ |
| EX. 2 | 140 | 210 or more | ○ | ◎ | Δ | ○ | ◎ | ○ | ◎ | ○ | ◎ |
| Ex. 3 | 130 | 210 or more | ◎ | Δ | ◎ | Δ | Δ | ◎ | Δ | Δ | ○ |
| Ex. 4 | 140 | 210 or more | ○ | ◎ | Δ | ◎ | ○ | Δ | ◎ | ○ | ◎ |
| Ex. 5 | 130 | 190 | Δ | Δ | ○ | ○ | ○ | Δ | ○ | ◎ | ○ |
| Ex. 6 | 140 | 210 or more | ○ | ○ | ○ | ○ | ○ | Δ | ○ | Δ | ○ |
| Ex. 7 | 145 | 195 | ○ | ○ | ○ | ◎ | ○ | Δ | ○ | ○ | ○ |
| Ex. 8 | 145 | 195 | ○ | ○ | ○ | Δ | ○ | Δ | Δ | Δ | Δ |
| Ex. 9 | 140 | 210 or more | ◎ | ○ | ○ | ○ | ○ | ○ | ◎ | ○ | ○ |
| Com. Ex. 1 | 130 | 140 | ○ | X | X | X | ○ | ○ | Δ | X | X |
| Com. Ex. 2 | 150 | 185 | ○ | Δ | X | ○ | X | Δ | X | X | X |
| Com. Ex. 3 | 145 | 150 | Δ | X | X | ○ | Δ | X | Δ | X | Δ |
| Com. Ex. 4 | 145 | 150 | X | ○ | X | Δ | X | Δ | X | X | X |
| Com. Ex. 5 | 145 | 150 | X | Δ | X | Δ | X | Δ | X | X | X |
| Com. Ex. 6 | 130 | 135 | ◎ | X | X | X | ○ | ○ | Δ | X | X |
| Com. Ex. 7 | 160 | 165 | X | ○ | X | Δ | Δ | Δ | X | X | X |

This document claims priority and contains subject matter related to Japanese Patent Application No. 2003-361586 filed on Oct. 22, 2003, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A toner comprising:

a binder resin; and a colorant, wherein the toner consist of a component that is soluble in hexafluoroisopropanol (HFIP) and a component that is not soluble in HFIP, the HFIP-soluble component of said toner satisfying the following relationship:

$$2{,}000 \leqq Mn \leqq 7{,}000 \text{ and } 1.5 \leqq Mw/Mn \leqq 10$$

wherein Mn represents a number-average molecular weight and Mw represents a weight-average molecular weight, wherein the HFIP-soluble component comprises a polyester obtainable by reacting at least one polyol and at least one carboxylic acid.

2. The toner of claim 1, wherein the toner comprises a HFIP-soluble component having a molecular weight not less than 100,000 in an amount of from 0.5 to 18%.

3. The toner of claim 1, wherein the toner is prepared by a method comprising:

dissolving a toner composition including a prepolymer in a solvent to prepare an oil drop; and dispersing the oil drop in an aqueous medium to perform at least one of an elongation reaction and a crosslinking reaction.

4. The toner of claim 1, wherein the toner comprises a polyester resin.

5. The toner of claim 1, wherein the toner comprises a modified polyester resin.

6. The toner of claim 1, wherein the toner has a shape factor SF-1 of from 101 to 1560 and a shape factor SF-2 of from 101 to 140.

7. The toner of claim 1, wherein the toner has a volume-average particle diameter (Dv) of from 2 to 7 μm and a ratio (Dv/Dn) of the volume-average particle diameter (Dv) to a number-average particle diameter (Dn) thereof not greater than 1.25.

8. A two-component developer comprising:

the toner according to claim 1; and a carrier comprising a magnetic particulate material.

9. An image forming method comprising:

charging an electrophotographic photoreceptor to form an electrostatic latent image thereon;

developing the electrostatic latent image with the two-component developer according to claim 8 to form a toner image thereon;

transferring the toner image onto a transfer sheet; and fixing the toner image on the transfer sheet.

cleaning the electrophotographic photoreceptor to remove the developer remaining thereon.

10. The toner of claim 1, wherein the toner has an average circularity of from 0.90 to 0.99.

* * * * *